US007511240B2

(12) United States Patent
Inagaki et al.

(10) Patent No.: US 7,511,240 B2
(45) Date of Patent: Mar. 31, 2009

(54) TRIGGER SWITCH

(75) Inventors: Isao Inagaki, Kanagawa (JP); Satoru Kowaki, Kanagawa (JP); Shinichi Masuda, Kanagawa (JP); Hideyuki Komatsu, Kanagawa (JP)

(73) Assignee: Satori S-Tech Co., Ltd., Tokyo (JP)

( * ) Notice: Subject to any disclaimer, the term of this patent is extended or adjusted under 35 U.S.C. 154(b) by 624 days.

(21) Appl. No.: 11/349,112

(22) Filed: Feb. 8, 2006

(65) Prior Publication Data

US 2006/0186102 A1 Aug. 24, 2006

(30) Foreign Application Priority Data

Feb. 9, 2005 (JP) ..... 2005-032939
Feb. 9, 2005 (JP) ..... 2005-032943

(51) Int. Cl.
*H01H 13/02* (2006.01)

(52) U.S. Cl. ..... 200/522; 200/9

(58) Field of Classification Search ..... 200/522, 200/6 B, 9, 18, 437; 173/2, 170–171, 217; 310/47, 50
See application file for complete search history.

(56) References Cited

U.S. PATENT DOCUMENTS 3,755,640 A * 8/1973 Kaman et al. ..... 200/522
4,572,997 A * 2/1986 Yamanobe et al. ..... 388/840
6,736,220 B1 * 5/2004 Chan et al. ..... 173/170
6,749,028 B1 * 6/2004 Chan et al. ..... 173/170
2004/0040827 A1 * 3/2004 Chu ..... 200/522

FOREIGN PATENT DOCUMENTS

JP 11-144545 5/1999
JP 2003-109451 4/2003

* cited by examiner

*Primary Examiner*—Renee S Luebke
*Assistant Examiner*—Sean Kayes
(74) *Attorney, Agent, or Firm*—Wenderoth, Lind & Ponack, L.L.P.

(57) ABSTRACT

To provide a trigger switch having a simple structure that is capable of reducing bouncing when the contacts are switched ON/OFF, the trigger switch includes a switch mechanism integrated in a single assembly a power control unit that turns a plurality of switches provided on the switch mechanism ON/OFF depending on a degree of retraction of the control unit by moving a pressing member over a top of a seesaw-shaped switching bar, a motor brake and control element short-circuit unit that drives a movable armature having two short-circuit contacts and is sandwiched and held between two springs, and a speed control unit that slides a plurality of moving contacts disposed in parallel over sliding contacts disposed on a sliding circuit substrate so as to control both the supply of power and a control element, and thus control the rotation speed of a motor.

11 Claims, 20 Drawing Sheets

TRIGGER SWITCH

BACKGROUND OF THE INVENTION

1. Field of the Invention

The present invention relates to a trigger switch mounted in a power hand tool such as an electric-powered drill or the like, and more particularly, to a trigger switch that switches a switch mechanism installed inside the power tool case according to the sliding of a control unit provided on the outside of the case.

2. Related Art

Conventionally, as a switch circuit for a trigger switch, there is known, for example, the trigger switch circuit for power tool disclosed in JP-A-11-144545. That is, the trigger switch circuit controls the rotation of a motor using a moving contact that moves in tandem with the retraction of an operating lever, such that, when the operating lever is in an OFF state, a motor brake switch is turned ON, the motor is shorted and the brake activated. When the operating lever is pulled in an ON state, the motor brake switch is turned OFF, a power switch is turned ON, and electric power is supplied to the sliding circuit substrate, the motor and a light-emitting diode (LED). The speed of rotation of the motor increases as the operating lever is pulled further, a short switch is turned ON and the rotation of the motor is maintained at high speed.

However, whenever such a switch circuit turns the power switch and the short switch ON and OFF, the switching element always remains controllable. Therefore, when the power switch and the short switch turn ON and OFF, the switching element also is turned ON and OFF, and thus an electric potential difference arises between the contacts of the power switch or the short switch, generating a spark when the power switch or the short switch is turned ON or OFF, which increases frictional wear on the contacts and in turn shortens the working life of the contacts.

In addition, since the rotation of the motor and the lighting of the LED are carried out simultaneously when the power switch is switched ON, it is necessary to add an auxiliary switch that is separate from and independent of the power switch in order to light the LED before the motor rotates. This addition of a component increases the price of the power hand tool or the like and hinders efforts to make to such tools more compact and thus easier to handle and more easily portable.

Moreover, in an effort to make the trigger switch thinner while retaining good dust-proof protection, there is, for example, the trigger switch disclosed in JP-A-2003-109451. This trigger switch incorporates the trigger mechanism inside a box-like case, projects a sliding shaft for external control of the switching outside the case, and mounts a trigger on the outside tip of the sliding shaft, while forcing the terminals of the control element into small through-holes so as to leave substantially no gap through which dust can enter, thus improving dust-proof protection.

Furthermore, an L-shaped metallic heat slinger with good thermal conductivity is fixedly mounted on the case to form a single unit therewith so as to absorb and radiate the heat generated by the control element. A switching lever fixed at one end about which the switching lever inclines is mounted on top of the case. The switching lever sets the rotation of the motor (forward or reverse) and has a neutral OFF position. In order to prevent the switching lever from being damaged, the switching lever switches to either one side or the other so that a trigger stopper of the trigger does not engage even if the trigger is retracted while the switching lever is in the neutral position. Moreover, furthermore, because of the bouncing that always occurs when the contacts switch ON, a brake contact for stopping the power hand tool motor is provided separately from the seesaw mechanism for preventing contact wear.

However, in such a trigger switch, because the heat slinger is L-shaped, when installed in the confined space of a power hand tool the heat comes to be radiated in a single direction. Consequently, when the temperature rises beyond a certain level, the rise in temperature tends to accelerate. As a result, the temperature of only the space on the heat slinger side rises, imparting an unpleasant feel to the place where the power hand tool is gripped.

In addition, because the sliding shaft for external control of the switching protrudes from the case and the trigger is mounted on the outside tip of the sliding shaft, dust gets inside the switch mechanism from a gap between the sliding shaft and a support member supporting the sliding shaft when the sliding shaft slides, which can cause malfunctions of the switch mechanism.

Furthermore, because the trigger switch is constituted so that the switching lever switches to either one side or the other so that the trigger stopper of the trigger does not engage even if the trigger is retracted while the switching lever is in the neutral position, the trigger cannot be operated when the lever is in the neutral OFF position and thus does not function as the safety mechanism that it is originally intended to be. In addition, the brake contacts are provided separately from the seesaw mechanism, thus increasing the number of parts.

SUMMARY OF THE INVENTION

Accordingly, it is an object of the present invention to solve the above-described problems of the conventional art and to provide, in a simple structure, a trigger switch capable of suppressing bouncing when the contacts are switched ON and OFF.

In addition, it is another object of the present invention to provide a trigger switch having circuitry that is capable of eliminating an electrical potential difference between the contacts of the switches when the power switch or the short-circuit switch turns ON or OFF and lighting the LED before the motor rotates so as to illuminate a workpiece before work thereon is begun, as well as to provide a simple technique for high-speed rotation control of the motor.

Furthermore, it is another and further object of the present invention to provide, in a trigger switch mounting a heat-generating member on the outside of a switch mechanism and which is equipped with a heat slinger to absorb heat generated by the heat-generating member, a structure of the heat slinger that is capable of absorbing heat uniformly when installed in a power hand tool, a mechanism that blocks dust from getting inside the switch mechanism from a gap between a sliding shaft operated externally and a support member that supports the sliding shaft, and a switch mechanism that provides improved vibration resistance and motor brake performance under harsh conditions involving heavy vibration.

Furthermore, it is still another and further object of the present invention to make the heat slinger compact and thus reduce the size of the switch mechanism itself, as well as to provide a structure that exerts no load on the central shaft of the lever when a switching lever for switching the direction of rotation of the motor is in a neutral OFF position.

To achieve the above-described object, the present invention provides a trigger switch including a switch mechanism equipped with a sliding circuit substrate and installed inside a case, and a control unit provided on the outside of the case to operate the switch mechanism according to sliding thereof, the switch mechanism including a power control unit that turns a plurality of switches provided on the switch mechanism ON and OFF depending on a degree of retraction of the control unit by moving a pressing member over a top of a seesaw-shaped switching bar; a motor brake and control element short-circuit unit that moves a movable armature having two short-circuit contacts, the movable armature sandwiched and supported by two springs; and a speed control unit that, by sliding a plurality of moving contacts arranged in parallel over sliding circuit contacts of the sliding circuit substrate, controls a supply of power and a control element so as to control rotation of a motor, the motor brake and control element short-circuit unit simultaneously short-circuiting the two short-circuit contacts provided on the movable armature against contacts of a short-circuit terminal strip against an urging force of the springs so as to effect an electrical connection, and short-circuiting the control element at some arbitrary point in time at which the degree of retraction of the control unit is increased.

Such a construction enables the bouncing that occurs when the contacts are switched ON/OFF to be suppressed, and moreover, can be used both as a short contact mechanism that maintains the pressure of contact by the contacts at or above a certain level due to the action of the load exerted by the spring as well as a brake contact mechanism with little bouncing, so as to achieve a stable state of contact.

Preferably, the switch mechanism comprises a switch circuit including a power switch connected in series to the motor; a switching element connected in series to the motor via the power switch; a short-circuit switch connected in parallel to the switching element; a motor brake switch that stops the motor; a drive unit that drive the switching element; a control switch that supplies voltage to the gate of the switching element when the control unit is retracted; and an auxiliary switch that supplies DC power to the drive unit when the control unit is retracted, the switch mechanism turning the auxiliary switch ON and supplying power to the drive unit when the control unit is retracted, when the power switch is turned ON and power is supplied to the motor, the switch mechanism turning the control switch ON and supplying voltage to the switching element gate through a resistance and making a state in which the control switch is turned ON a position at which DC power is supplied directly and directly supplying DC power to the switching element gate so as to place the switching element into a state in which it can be 100 percent electrically conductive, and further, turning the short-circuit switch ON and operating the power switch, the short-circuit switch, the motor brake switch, the control switch and auxiliary switch in tandem with the control unit.

Such a construction enables the switches to be turned ON without an electric potential difference therebetween, sharply limits the occurrence of sparks between the contacts of the switches, and allows the working life of the contacts to be extended.

Preferably, electric power is supplied to a light-emitting means when the auxiliary switch is ON. Such a construction enables the LED to light and the workpiece to be illuminated before the motor turns, contributing to the ease with which the power hand tool can be used by facilitating proper relative positioning of the workpiece and the power hand tool, and the like.

Preferably, the moving contacts that form the auxiliary switch and the control switch are single switch moving contact. Such a construction enables the number of components parts to be reduced and thus contributes to making the switch more compact.

Preferably, the switch mechanism is equipped with a switch circuit including reference signal output means that outputs a reference signal; operating signal output means that outputs a predetermined operating signal based on an operating state of an operating lever, a switching element connected in series to the motor that controls the rotation of the motor; and a comparator that inputs the reference signal from the reference signal output means to one input terminal and inputs the operating signal from the operating signal output means to another terminal, compares the input signals, and supplies a predetermined control signal to the switching element so as to turn the switching element ON and OFF; wherein the operating signal output means having a rotation control moving contact that connects a resistor Ra, a variable resistor Rc and a resistor Re in series between the power source and the ground, connects a resistor Rb in parallel to the variable resistor Rc, and straddles a variable contact and a sliding contact so as to electrically connect the variable contact and the moving contact; and a high-speed rotation switch provided between a starting position of the variable contact and the output side of a resistor Rd connected to the rotation control moving contact.

Such a construction enables high-speed rpm to be set simply by a single switch turning ON and OFF, thereby enhancing the use-value of the power hand tool as well as reducing its production cost by the equivalent of one switch. Moreover, such an arrangement permits the wiring of the sliding circuit substrate to be simplified and allows the number of switch assembly steps to be reduced.

Preferably, the trigger switch further comprises a control element housing formed on an exterior sidewall surface of a cover that covers the case and contains the control element, and a heat slinger that covers an outside surface of the cover and the case. Such a construction encloses the control element, which is a heat-generating body, on the outside the case, while at the same time making the heat-radiating means that contacts on a flat surface the cover which includes the control element large enough to cover the cover. As a result, the heat generated by the control element can be absorbed around substantially the entire outer periphery of the case, thus equalizing heat absorption and heat radiation.

Preferably, the trigger switch further comprises a control element housing formed on an exterior sidewall surface of a cover that covers the case and contains the control element, and a heat slinger that covers only an outside surface of the cover where the control element is located. Such a construction enables the bulkiness of the heat slinger to be eliminated and thus contributes to making the switch more compact.

Preferably, a plurality of packing structures is provided on a sliding shaft that slides according to sliding of the control unit. With such a construction, the packing prevents dust from entering the interior of the trigger switch with the sliding of the sliding shaft. Furthermore, internal packing prevents entry of dust that happens to get past outer packing, making it possible to substantially completely prevent dust from getting into the interior of the trigger switch.

Preferably, the sliding circuit substrate that comprises the switch mechanism installed inside the case is guided by internal side wall surfaces of the cover when inserted therein and engages a spring on a projection provided on an armature that forms the switch mechanism at a connecting part of the sliding circuit substrate so as to effect an electrical connection between the sliding circuit substrate and the switch mechanism.

Preferably, the trigger switch further comprises a control element housing formed on an exterior sidewall surface of a cover that covers the case and contains the control element, wherein the control element contained in the control element housing is an external structure. Such a construction enables a wide variety of user requirements to be accommodated in a single shape.

Preferably, the switch mechanism comprises a switching lever that uses the central shaft of the lever provided at a central location therein as a fulcrum and switches the rotation of the motor between forward, reverse and neutral OFF states, the switching lever configured so that when in the neutral OFF state, a lever projection provided on the switching lever is sandwiched between a lever stopper provided on the switch body and a trigger stopper provided on the control unit so as to stop the sliding of the control unit, and when the control unit moves in a direction of operation, the lever projection provided on the switching lever contacts the lever stopper provided on the switch body so as to stop exertion of force on the lever central shaft. Such a construction enables the trigger to be operated when the lever is in the central OFF position and at the same time acts as a safety mechanism.

Other objects, features and advantages of the present invention will be apparent from the following description when taken in conjunction with the accompanying drawings, in which like reference characters designate the same or similar parts throughout the figures thereof.

DETAILED DESCRIPTION OF THE PREFERRED EMBODIMENTS

A detailed description will now be given of preferred embodiments of the present invention, with reference to the drawings.

Figure 1:
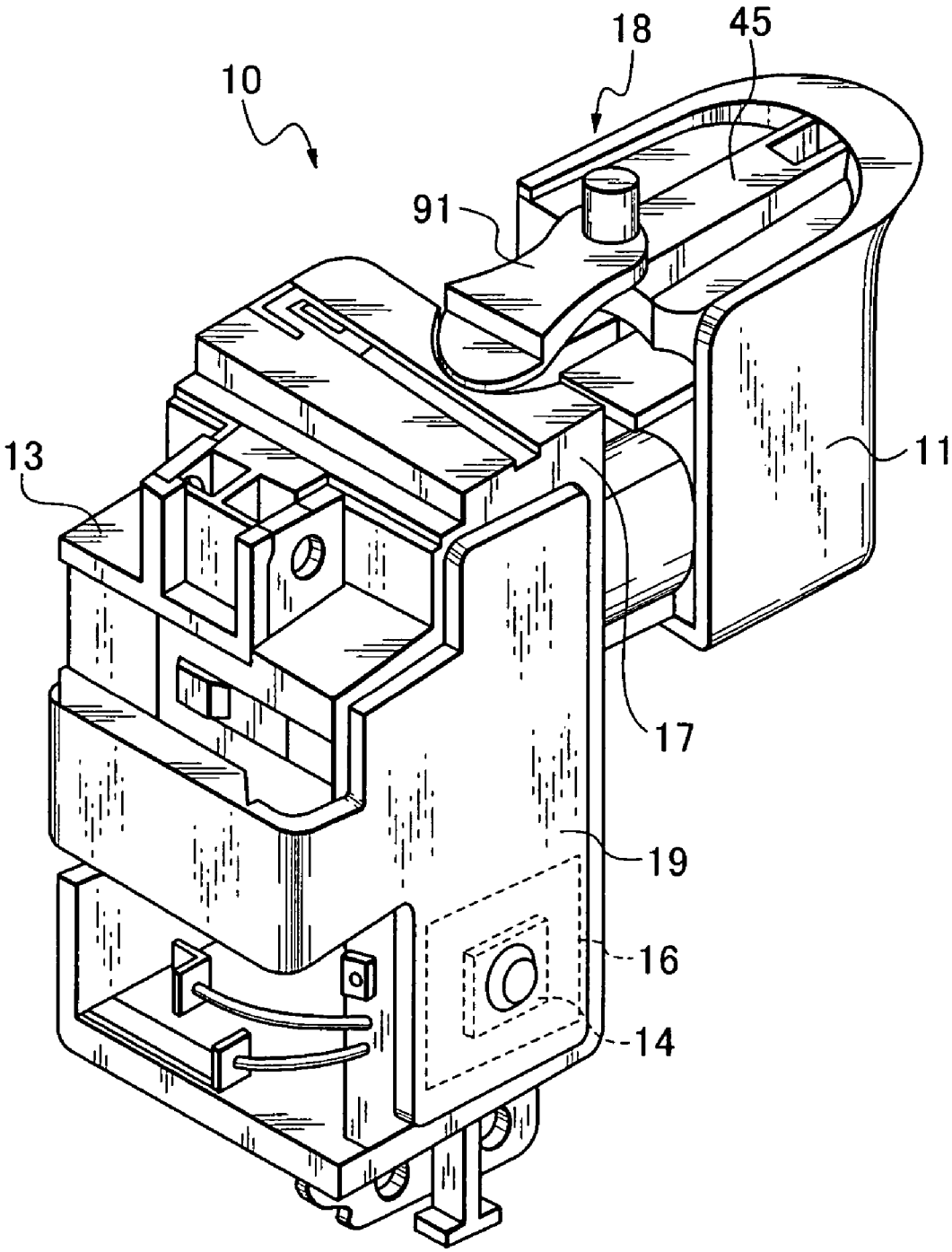
FIG. 1 is a perspective view showing a trigger switch according to a first embodiment of the present invention.
Figure 2:
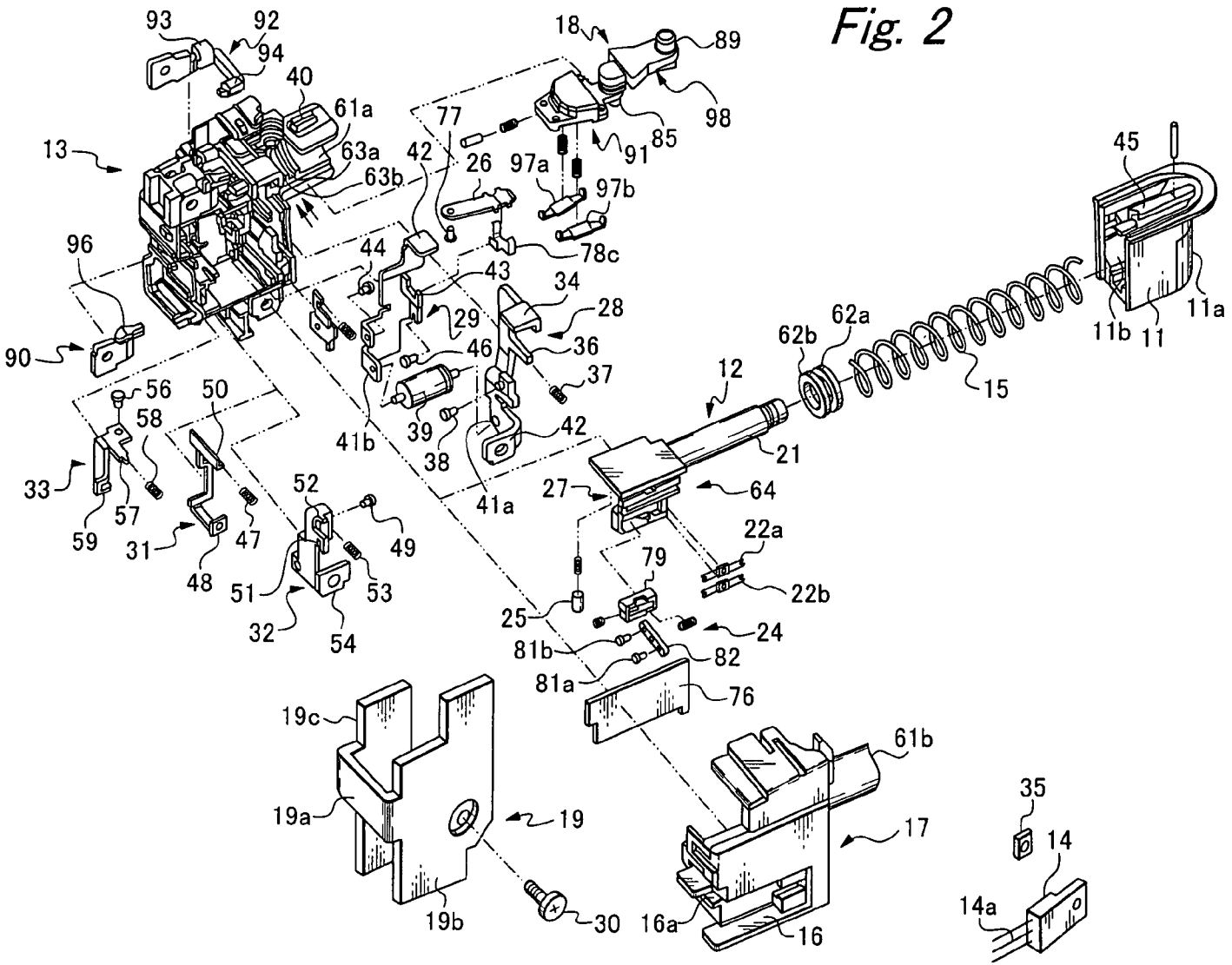
FIG. 2 is an exploded perspective view showing the trigger switch.

As shown in FIG. 1 and FIG. 2, a trigger switch 10 according to a first embodiment of the present invention comprises a rectangular case 13 which contains a switch mechanism and is provided with a sliding control element 12 that transmits the operating movement of a control unit 11 from the outside, a cover 17 that covers the surfaces of the openings in the sides of the case 13 and at the same time mounts a sliding circuit substrate on an inner wall surface thereof and is provided with an FET mount 16 for mounting a control element (hereinafter called an FET) on the outside of the cover 17, a control unit 11 which can be operated with the fingers of a hand, a switching control unit 18 located on a top surface of the case 13 that switches the rotation of a motor, and a heat slinger 19 formed substantially in the shape of a "C" in cross-section and disposed on the outer periphery of the case 13 and the cover 17.

The cover 17, as described above, covers the openings in the sides of the case 13 and at the same time mounts a sliding circuit substrate 76 on an inner wall surface thereof, and is provided with a concave FET mount 16 that mounts the FET 14 on the outside of the cover 17, with a semi-cylindrical shaft bearing armature 61*b* that slidably supports a sliding shaft 21 of the sliding control element 12 disposed on the top of the FET mount 16. The FET mount 16 seats the FET 14 in the concavity using a square nut 35 to engage a screw 30 for the purpose (see FIG. 2). A lead wire guide 16*a* that guides lead wires 14*a* of the FET 14 is formed on a forward edge of the FET mount 16. When the FET 14 is mounted on the FET mount 16, the surface of the FET 14 is flush with the surface of the sidewall of the cover 17. In other words, in a state in which the FET 14 is mounted on the FET mount 16 and mounted on the heat slinger 19, the surface of the FET 14 directly contacts the surface of the inside wall of the heat slinger 19.

The heat slinger 19 is formed substantially in the shape of a "C" in cross-section so as to cover the sidewall surfaces of the cover 17 and the case 13. A proximal surface 19*b* that is continuous with a connecting part 19*a* is formed so as to directly contact the front surface of the FET 14 contained in the FET mount 16 and sized large enough to cover the side wall surface of the cover 17. A distal surface 19*c* continuous with the connecting part 19*a* is formed to a size large enough to cover the sidewall surface of the case 13. Therefore, heat from the surface 19*b* that directly touches the FET 14 is dispersed directly to the surface 19*b* that covers the cover 17 and at the same time is dispersed as far as the surface 19*c* that covers the side wall surface of the case 13 via the connecting part 19*a*, so that the heat from the FET 14 is dispersed uniformly. It should be noted that, because the heat slinger 19 covers the side wall surface of the cover 17 as well as the side wall surface of the case 13, the heat generated by the constituent elements of the switch mechanism contained inside the case 13, such as a terminal strip 29 (see FIG. 2) is also dispersed via the surface 19*c*.

The sliding control element 12 forms the switch mechanism, and is constructed so as to allow the carrying out of four different functions with a single sliding operation when the control unit 11 is operated: Power is supplied to the motor, the speed of the motor is controlled by the operating state of the control unit 11, the circuits to the motor are shorted and power supplied by the operating state of the control unit 11, and the power circuit of the motor is shorted when the motor is stopped. The control unit 11 is a so-called trigger, shaped in the form of an oval column, with a grip part 11*a* formed in a side wall thereof, a shaft engagement part 11*b* that engages the sliding shaft 21 of the sliding control element 12 formed on a side opposite the grip part 11*a*, and a trigger stopper 45 formed in the shape of a rectangular parallelepiped on a top portion thereof. The trigger stopper 45, when the switching control unit 18 is at a neutral point, stops the retraction of the control unit 11. This point is described in detail later.

Figure 3:
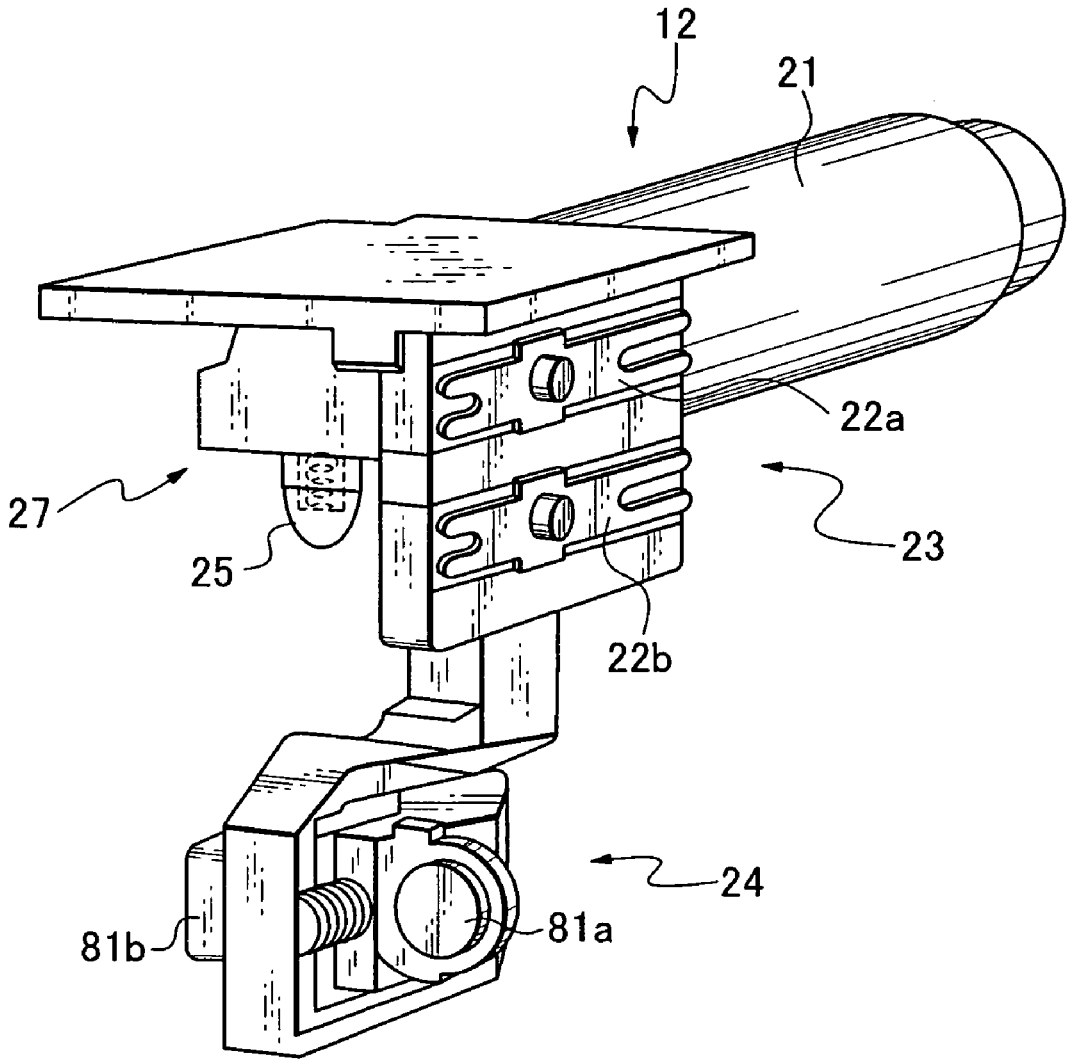
FIG. 3 is a perspective view showing a sliding control unit of the trigger switch.

The sliding control element 12, as shown in FIGS. 2 and 3, consists of a rod-shaped sliding shaft 21 that can mount the control unit 11 on a free end part; a speed control unit 23 composed of two moving contacts disposed parallel to side walls at the base of the sliding shaft 21, a rotation control moving contact 22*a* and a switch moving contact 22*b*, and that controls the speed of rotation of the motor; a motor brake and control element short-circuit unit 24 disposed beneath the speed control unit 23 that short-circuits the motor and the control element; and a power control unit 27 provided on a side wall opposite the speed control unit 23 that switches a switching bar 26 that supplies power to the FET that switches the motor ON and OFF.

As shown in FIG. 2, the terminal strip driven by the speed control unit 23, the motor brake and control element short-circuit unit 24 and the power control unit 27 and formed as a conductive metal member is composed of five armatures: A terminal strip 29, a positive power terminal strip 28, a control element connection terminal strip 31, a negative power terminal strip 32 and a control element connection terminal strip 33.

Figure 4A:
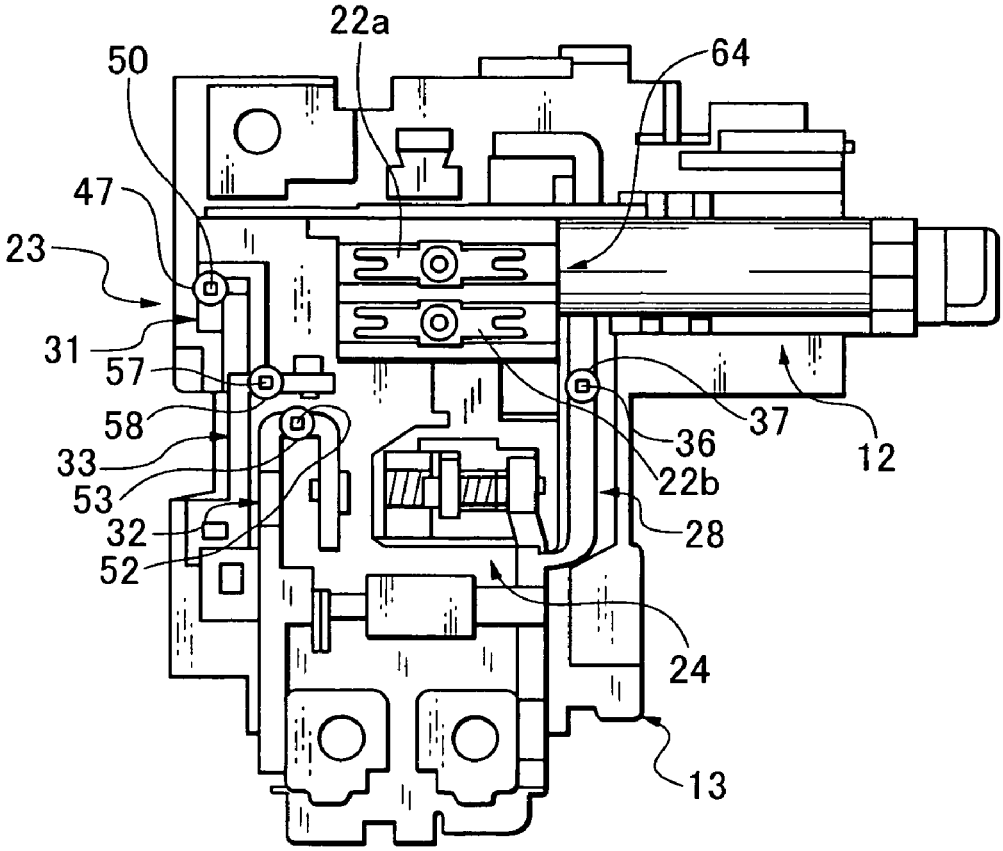
FIG. 4A is a side view showing the arrangement of switch mechanism with a cover of the trigger switch removed.
Figure 4B:
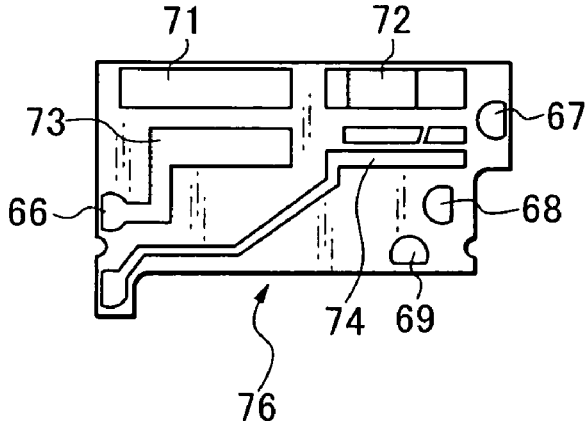
FIG. 4B is a plan view showing a sliding circuit substrate of the switch mechanism.
Figure 5A:
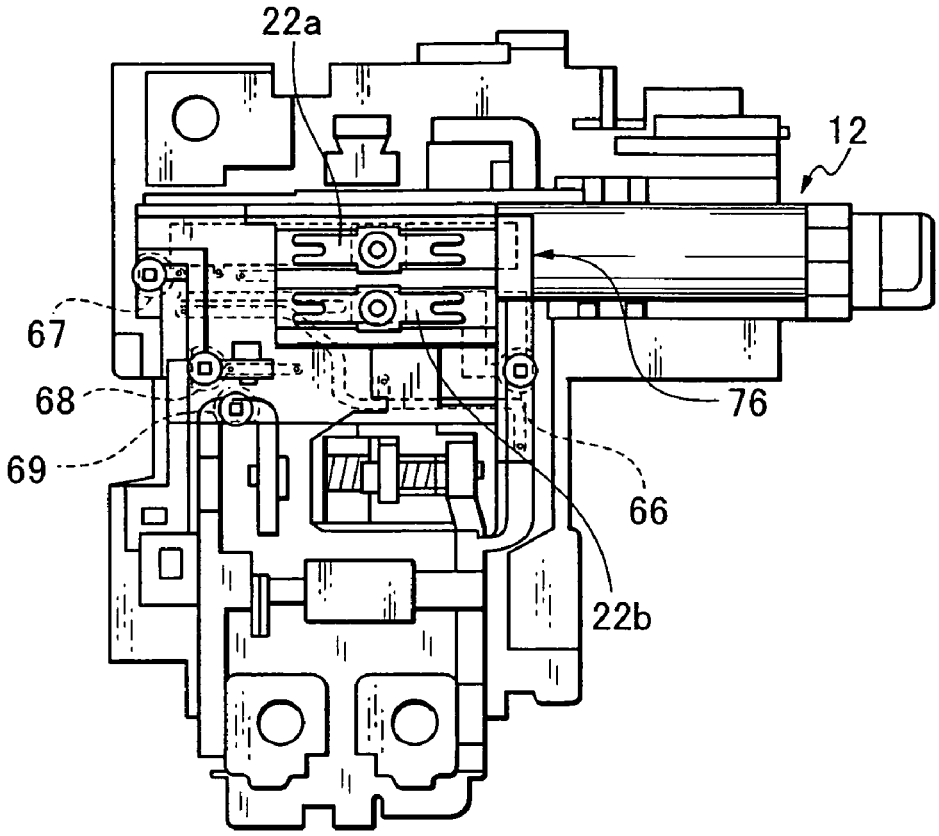
FIG. 5A is a side view showing the sliding circuit substrate disposed in the switch mechanism.
Figure 5B:
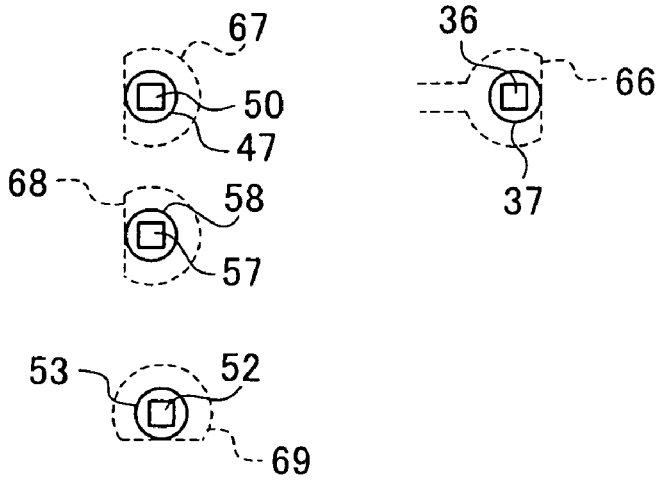
FIG. 5B is a diagram showing springs disposed on projections on the sliding circuit substrate.
Figure 6A:
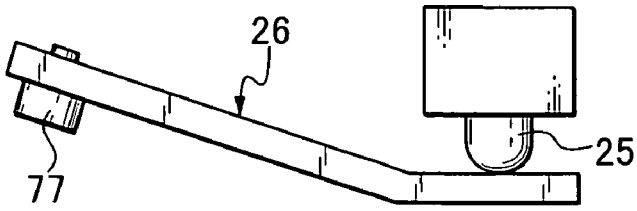
FIG. 6A is a side view showing the operating principle of a switching bar of the switch mechanism.
Figure 6B:
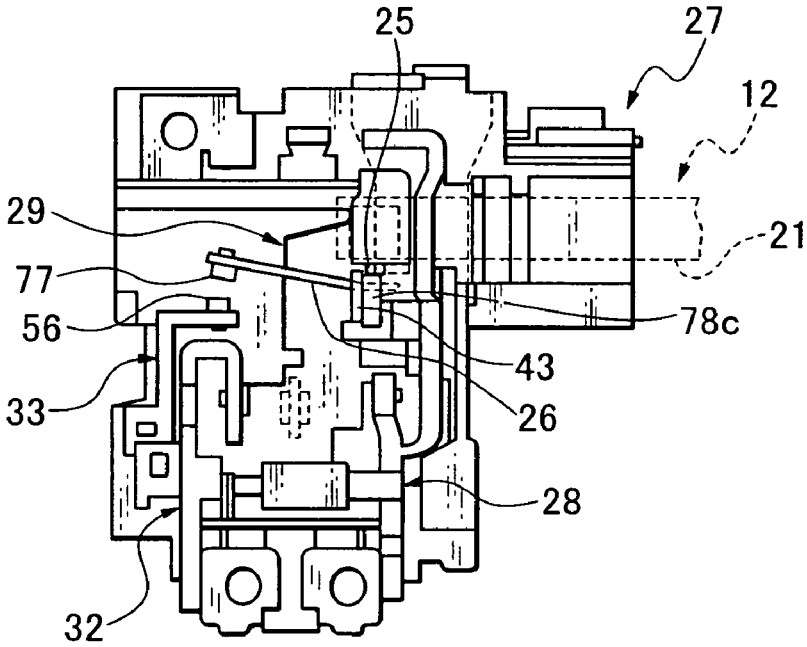
FIG. 6B is a side view showing the switch mechanism with the switching bar at the center.
Figure 6C:
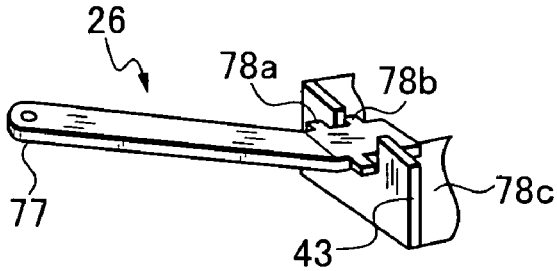
FIG. 6C is a perspective view showing the mounting of the switching bar.

The positive power terminal strip 28, as shown in FIG. 2, is formed as a tongue-shaped conductive member, the tips of whose long, thin plate members are bent in directions that are perpendicular to the rest of the terminal strip 28. It comprises a first switch contact 34 among the switch contacts used by the switching control unit 18 and a projection 36 beneath the first switch contact 34 that protrudes in the direction of the first switch contact 34, and is formed so as to engage a first spring 37 for contacting a first contact spring connecting part 66 (see FIG. 4B) of the sliding circuit substrate 76 on the top of the projection 36. Further, a motor brake contact 38 that contacts a short-circuit contact 81*a* of the motor brake and control element short-circuit unit 24 of the sliding control element 12 is provided beneath the projection 36. A diode connecting part 41*a* that connects one of the terminals of a diode 39 is provided beneath the motor brake contact 38, with a connecting part 42 bent perpendicularly in the horizontal direction of the diode connecting part 41*a* that connects to an external terminal. A positive power terminal is connected to the connecting part 42.

As shown in FIG. 2, the terminal strip 29 is formed as a substantially S-shaped conductive strip-like member whose tips are bent in directions perpendicular to the rest of the terminal strip 29, and comprises a second switch contact 42 among the switch contacts used by the switching control unit 18 and a switching bar engagement part 43 formed in the shape of an enlarged "C" with the open side facing up and that forms the fulcrum of the seesaw that is the switching bar 26 that forms the power control unit 27 disposed beneath the second switch contact 42. A short-circuit contact 44 and a motor brake contact 46 are disposed opposite each other at positions beneath the switching bar engagement part 43. A connecting part 41*b* for connecting the other terminal of the diode 39 is provided beneath the two contacts that are the short-circuit contact 44 and the motor brake contact 46.

As shown in FIG. 2, the control element connection terminal strip 31 is a strip-like conductive member the top of which is formed into a substantially C-shaped protruding projection 50, the top of which engages a second spring 47 for contacting the contacts of the sliding circuit substrate 76 and whose opposite tip therefrom is bent into a connecting part 48 that connects to the gate of the control element FET.

As shown in FIG. 2, the negative power supply terminal strip 32 is a strip-like conductive member, the top portion of which is bent into the shape of a "U", on a free end of which is provided a contact 49, with an intermediate connecting part 51 of the armature provided at the base of the U-shaped part and to which the control element FET source is connected, a projection 52 formed on the bent arms of the U-shaped part, the top of which engages a fourth contact spring 53 for contacting the contacts of the sliding circuit substrate 76, and a connecting part 54 bent in a direction perpendicular to the rest of the strip for connecting to an external terminal is provided on the bottom of the strip. A negative power supply is connected to the connecting part 54.

As shown in FIG. 2, the control element connection terminal strip 33 is a rectangular strip-like conductive member, the top end of which is bent in a direction perpendicular to the rest of the strip into a power contact 56 for supplying power, a projection 57 that protrudes from a portion of the strip that is bent in a direction perpendicular to that of the power contact 56, the tip of the projection 57 engaging a third contact spring 58 for contacting the contacts of the sliding circuit substrate 76. The bottom tip of the control element connection terminal strip 33 is bent in a direction opposite that of the power contact 56 and forms a connecting part 59 that connects to the drain of the control element FET.

These five armatures shaped as described above are contained within the case 13. When viewed from the opening of the case 13, terminal strip 29 is placed in the middle of the bottom of the enclosure that forms the switch mechanism, with the second switch contact 42 facing up, the switching bar engagement part 43 vertical with respect to the bottom, the short-circuit contact 44 and the motor brake contact 46 disposed horizontally opposite each other, and at the bottom the connecting part 41*b* facing the opening of the case 13.

The positive power terminal strip 28 is placed to the right of the terminal strip 29 positioned as described above, with the first switch contact 34 facing up, the projection 36 facing the opening of the case 13, the motor brake contact 38 beneath the projection 36 facing left, and at the bottom the connecting part 42 that connects to an external terminal facing the opening of the case 13.

The control element connection terminal strip 31 is positioned at the bottom left of the enclosure with respect to the opening in the case 13, with the projection 50 facing toward the opening, and the bottommost connecting part 48 also facing the opening.

The control element connection terminal strip 33 is positioned above the control element connection terminal strip 31 position as described above, with the power contact 56 facing up, the projection 57 facing in the direction of the opening, and the connecting part 59 also facing the opening.

The negative power terminal strip 32 is positioned on the inside of the control element connection terminal strip 33 position as described above, with the contact 49 facing inward, the projection 52 facing the opening, and the intermediate connecting part 51 and the connecting part 54 that connects to an external terminal also facing in the direction of the opening.

The sliding shaft 21 is slidably supported by shaft bearings 61*a*, 61*b* formed by the case 13 and the cover 17, with packing containers 63*a*, 63*b* provide on the shaft bearings 61*a*, 61*b* in such a way as to be able to position two packings 62*a*, 62*b* spaced a certain interval apart. On the outside of the shaft bearing 61*a* a lever engagement projection 40 formed in the shape of a rectangular parallelepiped is formed integrally as a single unit with the shaft bearing 61*a*. When the switching control unit 18 to be described later is at a neutral position, the lever engagement projection 40 stops the retraction of the control unit 11.

The tip of the sliding shaft 21 is exposed to the outside and mounts the control unit 11. Even if dust from the sliding shaft 21 gets past the first packing 62*a*, since the second packing 62*b* is located behind the first packing 62*a*, the dust is prevented from entering by the second packing 62*b*. In other words, a large amount of dust adheres to the slide shaft 21 from the exposed portion to the first packing 62*a* and enters through the shaft, with the amount of dust that penetrates being reduced by the first packing 62*a*. The reduced amount of dust then enters a dust collection point, but the reduction in the amount of dust at the first packing 62*a* and the presence of a slight gap that is the dust collection point makes further entry of the dust difficult, and thus, in the vicinity of the second packing 62*b*, compared to the exterior of the switch, the amount of dust involves becomes very small, enabling the dust to be substantially completely prevented from entering the interior of the switch at the second packing 62*b*. Therefore, dust does not fall into the interior of the switch and cause bad connections.

As shown in FIGS. 2, 3 and 6A through 8A, the power control unit 27 switches the power switch that supplies power to the motor ON and OFF depending on the amount by which the sliding shaft 21 of the sliding control element 12 is pushed, and thus the switching bar 26, which is formed in the shape of a narrow, strip-like conductive member, is provided on a proximal end with a contact 77 that supplies power and a pair of bent guide tabs 78*a*, 78*b* provided on a distal end that protrude in the direction of the width of the switching bar 26. The switching bar 26 is mounted by engaging the switching bar engagement part 43, which is provided on the terminal strip 29 and formed by cutting out, with that part of the switching bar 26 member that lies between the guide tabs 78*a*, 78*a*, with a rear pair of guide tabs 78*b* sandwiched by a leaf spring 78*c* so as to be mounted. When OFF, the contact 77 of the switching bar 26 is disposed opposite the power contact 56 of the control element connection terminal strip 33 positioned in the case 13.

When the switching bar 26 is disposed as described above, a sliding knob 25 (see FIG. 3) is mounted on a top surface of the switching bar 26 thus disposed. A spring is incorporated in the sliding knob 25, such that the sliding knob 25 can be maintained in a constant state of coercion. In other words, when the sliding knob 25 is positioned atop the switching bar 26, the sliding knob 26 presses against the top of the switching bar 26. When the sliding control element 12 is not operated the spring is retracted, and therefore the position of the sliding knob 25 is in the vicinity of the guide tabs 78*b* of the switching bar 26, and the contact 77 faces upward, that is, is separated from the power contact 56.

Figure 7:
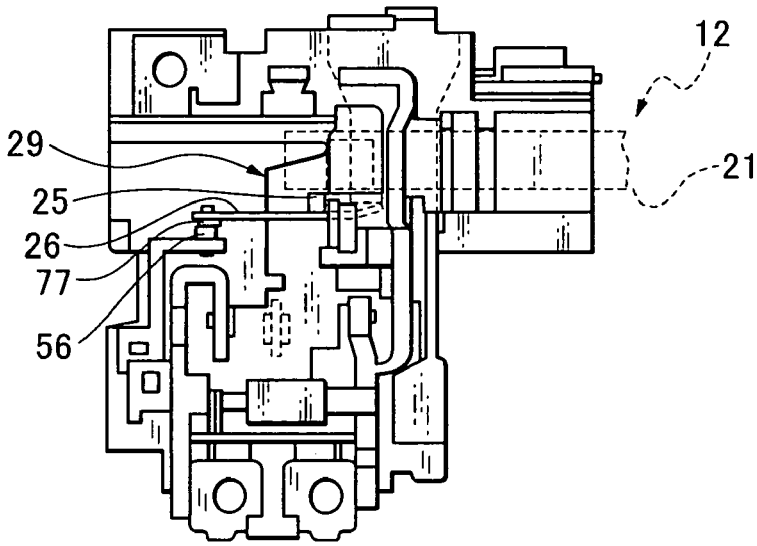
FIG. 7 is a side view showing a state of the switch mechanism when a forward edge of the switch mechanism contacts a contact.
Figure 8A:
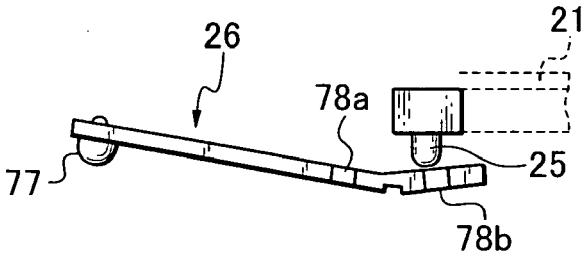
FIGS. 8A and 8B are side and plan views, respectively, showing the relation between the switching bar and a sliding knob on a sliding shaft.
Figure 8B:
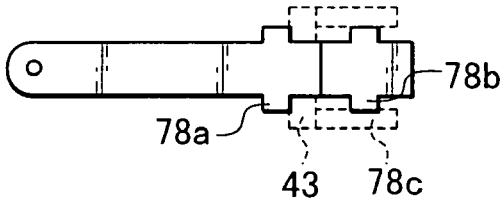

When the sliding control element 12 is retracted, the sliding shaft 21 moves and, as shown in FIG. 7, the sliding knob 25 that is a pressing member moves toward the contact 77 while sliding over the top of the switching bar 26. Then, when the sliding knob 25 passes the bent portion, the sliding knob 25 rides up onto the slanted top surface by the amount of the bend, is returned in the horizontal direction and the contact 77 contacts the power contact 56. This arrangement completes a system whereby power is supplied to the motor, not shown, after which the rotation speed of the motor is controlled by the speed control unit 23.

As shown in FIGS. 2, 3, 4A, 4B, 5A and 5B, the speed control unit 23 comprises a moving contact part 64, coupled to the sliding control element 12 and equipped with the rotation control moving contact 22*a* and the switch moving contact 22*b* so as to move in tandem with the sliding control element 12, and the sliding circuit substrate 76, provided with first through fourth contact spring connecting parts 66, 67, 68 and 69 for electrically connecting to first through fourth contact springs 37, 47, 58 and 53 provided respectively on the positive power terminal strip 28 having the projecting part 36 that engages the first contact spring 37, the control element connection terminal strip 31 having the projecting part 50 that engages the second contact spring 47, the control element connection terminal strip 33 having the projecting part 57 that engages the third contact spring 58 and the negative power terminal strip 32 having the projecting part 52 that engages the fourth contact spring 53, all contained within the case 13. The sliding circuit substrate 76 is also provided with a sliding contact 71, a variable contact 72, a control contact 73 and an auxiliary contact 74.

The positive power terminal strip 28, the control element connection terminal strip 31, the negative power terminal strip 32 and the control element connection terminal strip 33 have the structures described above and are positioned within the case in the layout described above, and therefore a description thereof is omitted here.

The sliding circuit substrate 76 mounts circuit elements on its front surface and comprises the first through fourth contact spring connecting parts 66, 67, 68, 69, the moving contact part 64, the sliding contact 71, the variable contact 72, the control contact 73 and the auxiliary contact 74. The first through fourth contact springs 37, 47, 58 and 53 on the case side, which are engaged by the inner side wall surfaces of the cover 17 when the cover 17 is mounted on the case 13, are contacted by the first through fourth contact spring connecting parts 66, 67, 68 and 69, and further, the sliding contact 71, the variable contact 72, the control contact 73 and the auxiliary contact 74 the rotation control moving contact 22*a* and the switch moving contact 22*b* are contacted with an elastic force.

Performing all electrical connections in a state of contact as described above enables assembly of the trigger switch 10 to be simplified. At the same time, interposing springs in the contacts enables stable, vibration-proof contact states to be maintained.

The moving contact part 64 aligns the rotation control moving contact 22*a* and the switch moving contact 22*b* in parallel. The rotation control moving contact 22*a* and the switch moving contact 22*b* are conductive members formed as long, thin strip-like members, both end portions of each of which are forked in the shape of a bow overall. The forward end of such forked portion is bent both upward and downward to form contacts, with a hole formed in the center of the members and engaging a boss projected from a base part. Moreover, the edges along both sides of the part where the central hole is formed are bent at right angles so as to increase the strength and prevent setting.

When the sliding control element 12 is operated against a return spring by the control unit 11, the moving contact part 64 constituted as described above causes the rotation control moving contact 22*a* and the switch moving contact 22*b* to contact the sliding contact 71, the variable contact 72, the control contact 73 and the auxiliary contact 74 of the sliding circuit substrate 76, and this state of contact causes the motor rpm to move from 0 percent to 100 percent in tandem with the ON state of the power switch of the power control unit 27. When the motor rpm reaches 100 percent, the motor brake and control element short-circuit unit 24 operates and short-circuits, so that 100 percent power is supplied to the motor.

The motor brake and control element short-circuit unit 24, as shown in FIGS. 2-4A and FIGS. 9A-11B, is provided with a short sliding frame 79 inside a short movable frame 78, inside of which is mounted a movable armature 82 provided with two short-circuit contact 81*a*, 81*b*, with the movable armature held by a contact support spring 83. Within the movable frame 78, a sliding frame spring 84 is mounted on an inner wall surface of the sliding frame 79 from a direction opposite that of the sliding frame spring.

An engagement flange 87 that moves along a sliding frame guide groove 86 provided on one portion of an inner wall surface of the moving frame 78 is provided on the sliding frame 79, as well as a movable armature guide groove 88 in which the movable armature 82, which is contacted at one end by the contact support spring 83, can move against pressure applied to the short-circuit contacts 81*a*, 81*b*.

Figure 9A:
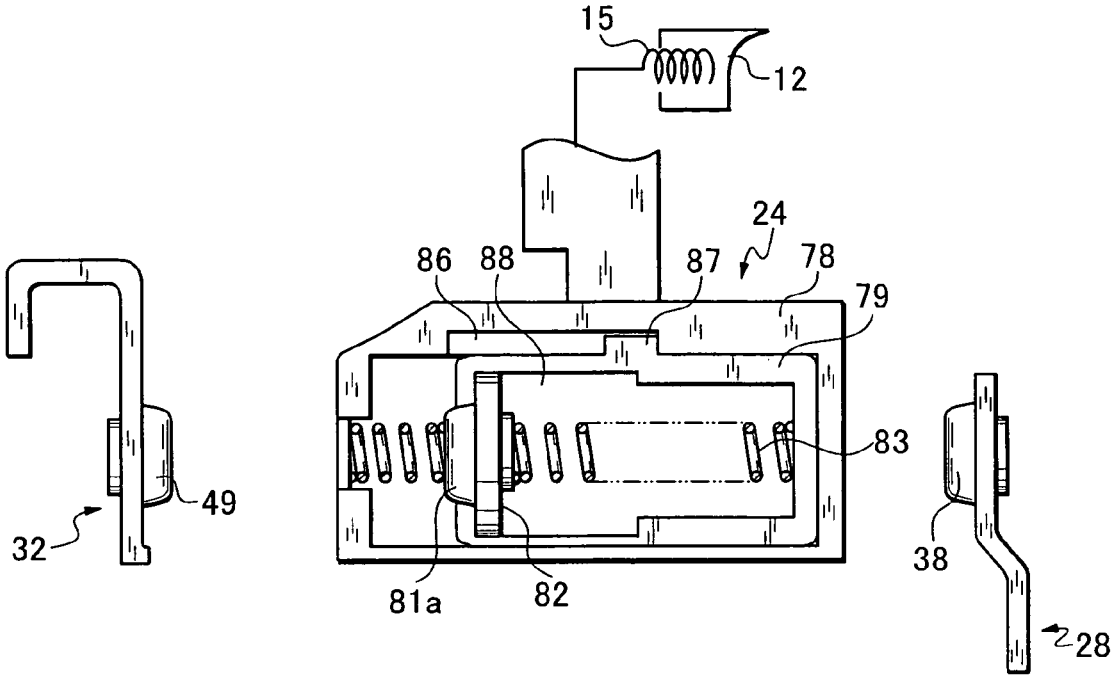
FIG. 9A is a side view showing the relation between a motor brake short-circuit part and a negative power terminal strip and a positive power terminal strip of the switch mechanism.
Figure 9B:
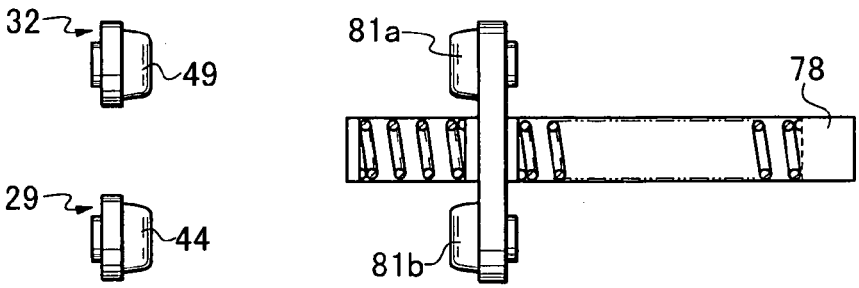
FIG. 9B is a plan view showing the relation between the motor brake short-circuit part and the negative power terminal strip and terminal strip.
Figure 10A:
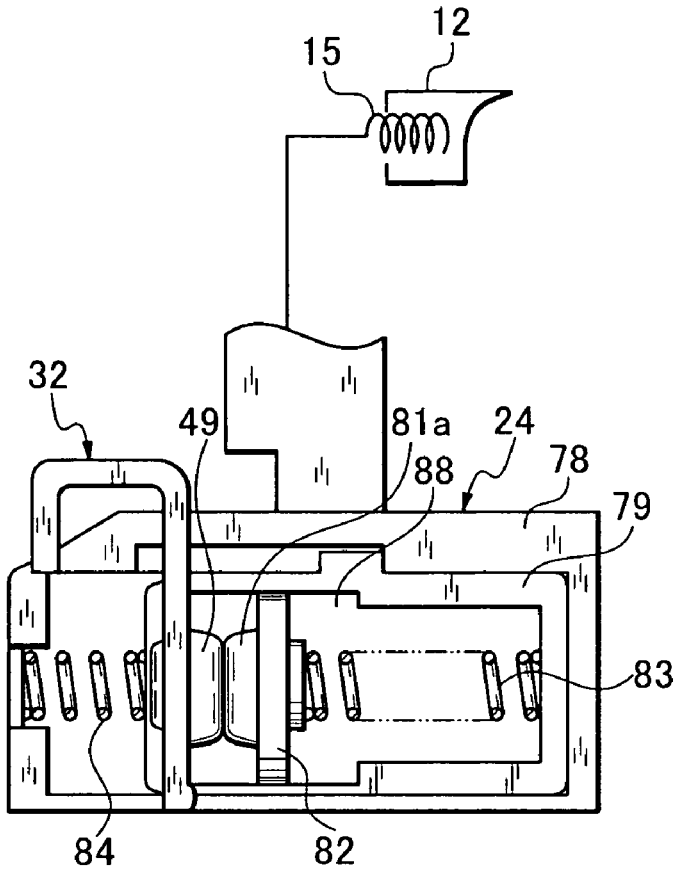
FIG. 10A is a side view showing a state of contact between the motor brake short-circuit part and contacts of the negative power terminal strip.
Figure 10B:
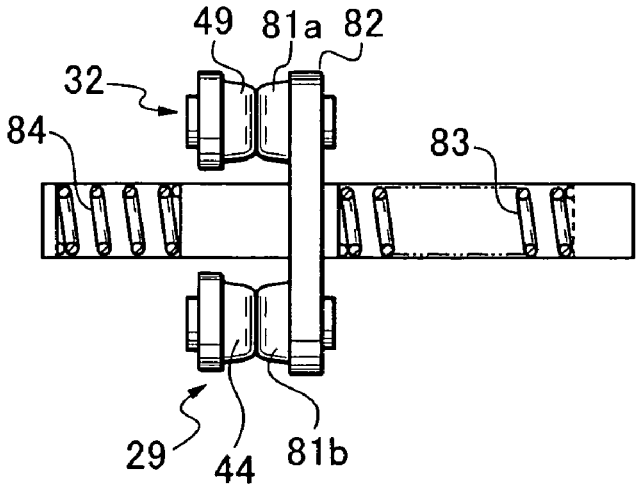
FIG. 10B is a plan view showing the state of contact between the motor brake short-circuit part and the contacts of the negative power terminal strip and the terminal strip.

In the motor brake and control element short-circuit unit 24 constituted as described above, first, when the sliding control element 12 is pushed in the state shown in FIGS. 9A and 9B, the movable frame 78 of the coupled motor brake and control element short-circuit unit 24 also moves in the same direction as the sliding control element 12 and the short-circuit contacts 81*a*, 81*b* of the movable armature 82 move in the direction of the negative power terminal strip 32. Then, as shown in FIGS. 10A and 10B, when the sliding control element 12 is pushed further, short-circuit contact 81*a*, 81*b* of the movable armature 82 contact the contact 49 of the negative power terminal strip 32 and the contact 44 of the terminal strip 29, respectively. When in this state the sliding control element 12 is pushed still further, the movable armature 82 pushes against and is stopped by the force exerted by the contact support spring 83 inside the sliding frame 79 while the sliding frame 79 itself moves in the direction in which it is pushed, to the position shown in FIGS. 10A and 10B. In other words, in the state in which the contacts (81*a* and 49, 81*b* and 44) are in contact with each other, the contact of the contacts is maintained by the force of the contact support spring 83 and is thus extremely good.

Figure 11A:
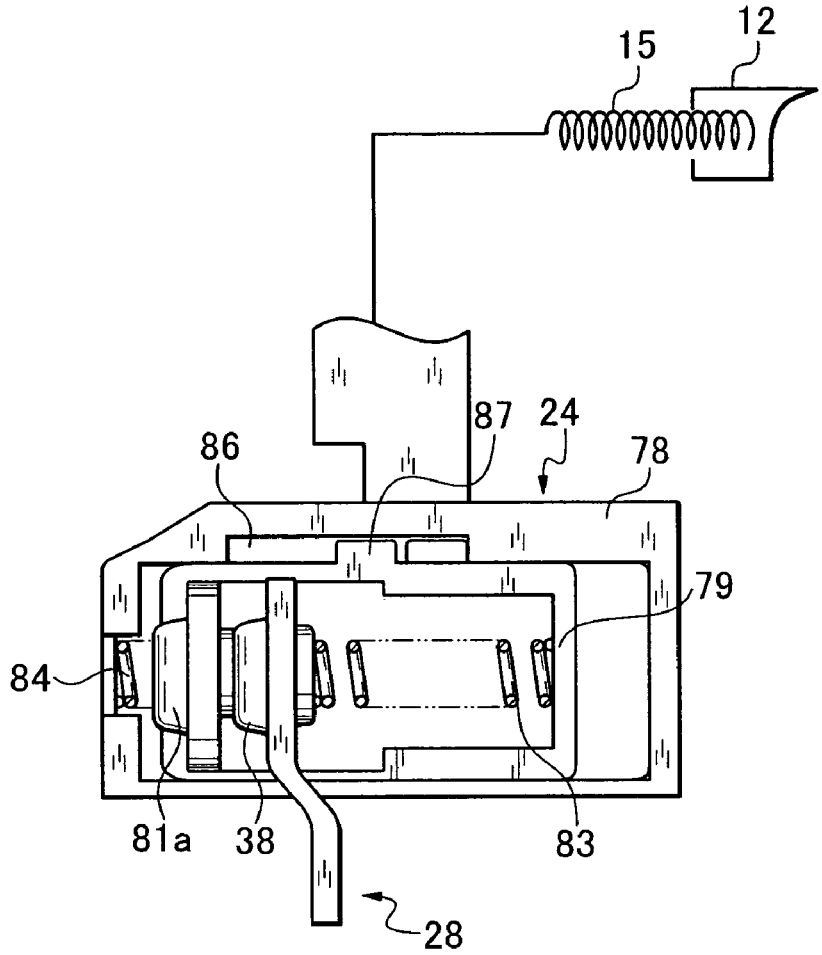
FIGS. 11A and 11B are side and plan views, respectively, showing the state of contact between contacts of the motor brake short-circuit part and the contacts of the positive power terminal strip and the terminal strip.
Figure 11B:
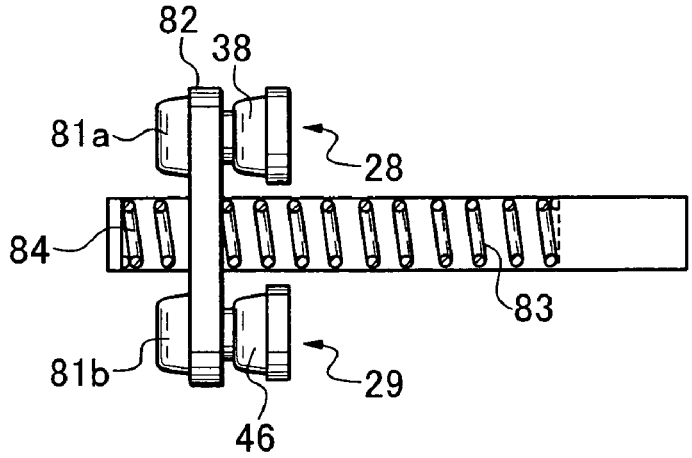

Next, when the sliding control element 12 is pulled to an initial position by the return spring 15, as shown in FIGS. 11A, 11B, the movable frame 78 moves in tandem with the sliding control element 12 and the short-circuit contacts 81*a*, 81*b* of the movable armature 82 of the sliding frame 79 move toward the positive power terminal strip 28, causing the contact 81*a* of the movable armature 81 to contact the motor brake contact 38 of the positive power terminal strip 28 and the contact 81*a* of the movable armature 81 to contact the motor brake contact 46 of the terminal strip 29. Then, when the contacts (38 and 81*a*, 46 and 81*b*) are in a state of contact with each other and the movable frame 78 moves further, the movable frame 78 pushes the sliding frame spring 84, causing the sliding frame 79 itself to be guided as it moves by the engagement flange 87 that engages the sliding frame guide groove 86 and held in a state in which the contact between the contacts is held by the sliding frame spring 84.

As can be understood from the foregoing operations, the contacts 81*a*, 81*b* provided on the movable armature 82 have the functions of short-circuiting the control elements and rotating the motor at 100 percent power, braking the motor by shorting across the motor, and having short and brake contacts while bridging the contacts with little bouncing. As a result, the number of components can be reduced.

Figure 12:
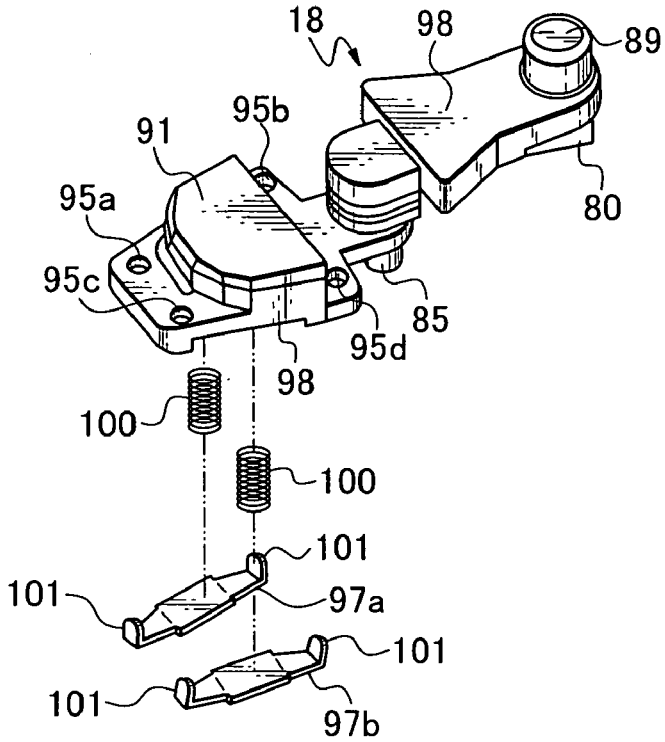
FIG. 12 is an exploded perspective view showing the trigger switch.
Figure 12:
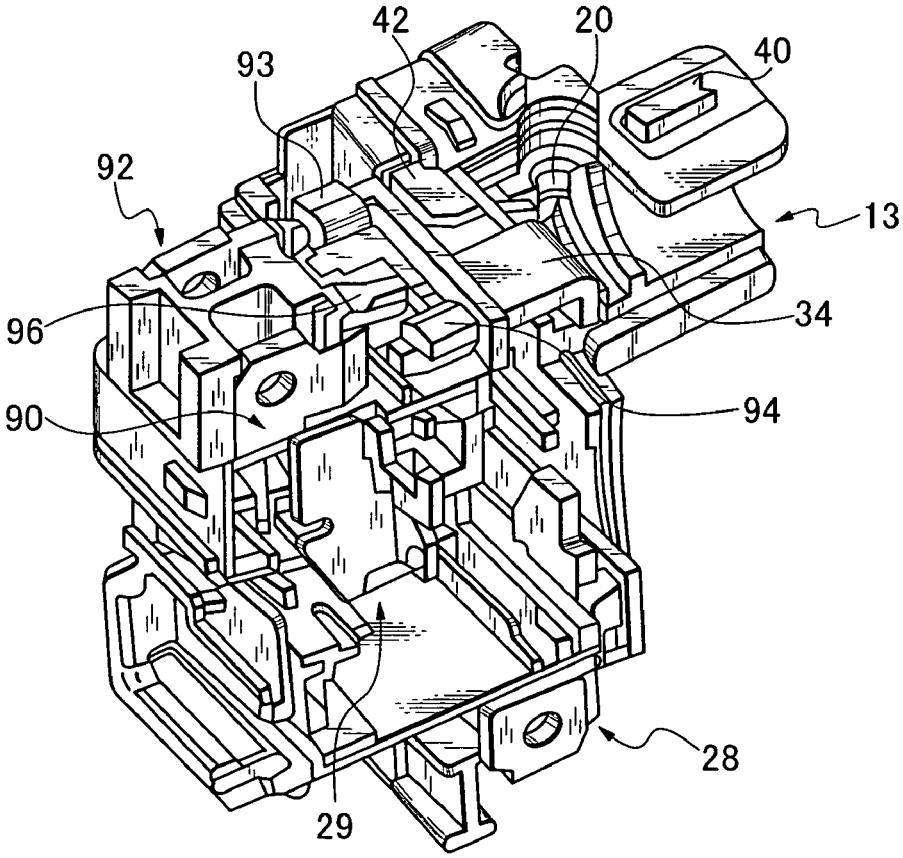
Figure 13:
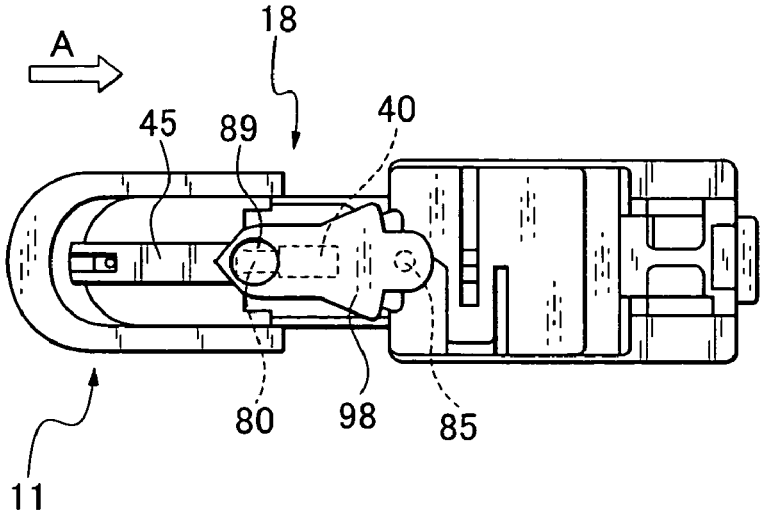
FIG. 13 is a plan view showing the switching control unit.
Figure 14:
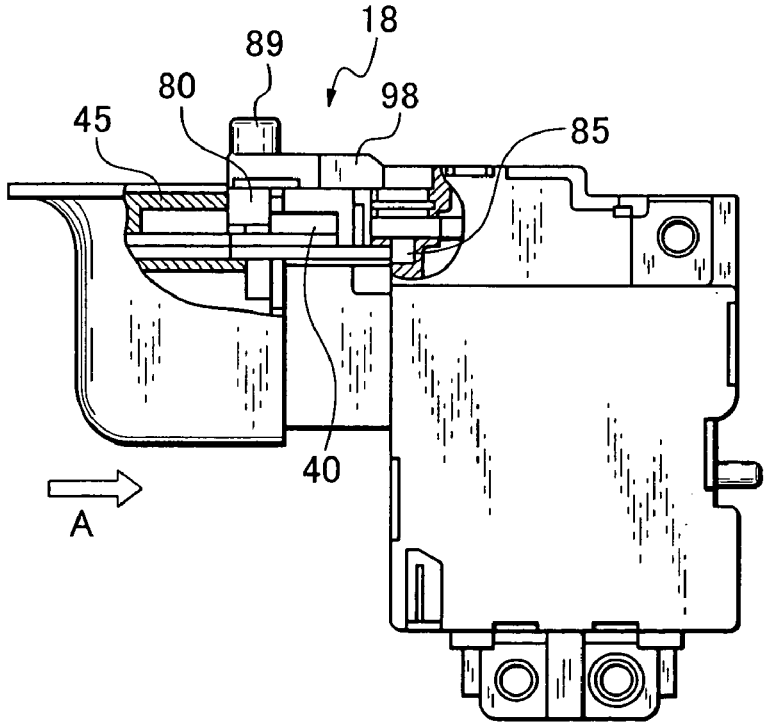
FIG. 14 is a side view showing the switching control unit.

As shown in detail in FIGS. 12-14, the switching control unit 18 comprises a knob 89 formed so as to protrude from a forward tip portion of a fan-shaped lever 98 and a switching terminal part 91 formed substantially in the shape of a semi-circular column at a position continuous with but removed from the knob 89 and offset by one level from the knob 89, and a lever central shaft 85 formed so as to extend beneath the junction of the lever 98 and the switching terminal part 91. A rounded-tip lever projection 80 is provided on a surface of the forward edge of the lever 98 opposite the side on which the knob 89 is formed.

The switching terminal part 91 engages and rotates two connecting armatures 97*a*, 97*b* arranged in a form of widening each other toward the end so as to change the Connections of the contacts. By switching the contacts of the two connecting armatures 97*a*, 97*b* among five contacts—the first contact 34 provided on top of the positive power terminal strip 28, the second contact 42 provided on top of the terminal strip 29, a third contact 932 provided on a base of an arm of a second switching terminal strip 92, a fourth switching contact 94 provided on a free end of the arm of the second switching terminal strip 92, and a fifth contact 96 provided on top of a third switching terminal strip 90—the rotation of the motor is switched between forward and reverse.

The lever central shaft 85 provided at the junction of the lever 98 and the switching terminal part 91 engages the central hole 20 in the case 13 and forms the center of the rotation of the switching terminal part 91. Apertures 95*a*, 95*b*, 95*c* and 95*d* that engage the connecting armatures 97*a*, 97*b* arranged in a form of widening each other toward the end are provided on the switching terminal part 91. Springs 100 engage holes provided at central locations that tie together the apertures (95*a*, 95*b*, 95*c* and 95*d*) constantly urge the connecting armatures 97*a*, 97*b* toward the central position.

The two connecting armatures 97*a*, 97*b* form a contact surface that contacts long, thin engagement projections formed by bending both ends of the connecting armatures 97*a*, 97*b* substantially vertically upward in the same direction against contacts on the surface on a side opposite the side on which the engagement projections 101 are formed and protrude (that is, the third switching contact 93 and the second switching contact 42 and the fifth switching contact 96 and the first switching contact 34, or the second switching contact 42 and the fifth switching contact 96 and the fourth switching contact 94 and the first switching contact 34). The centers of the connecting armatures 97*a*, 97*b* on which the engagement projections 101 are formed at both ends thereof are subjected to the pressing force of the springs 100, such that the contact surface is continuously pressed toward the contacts.

When the knob 89 on the lever 98 is pushed manually in one direction, the switching control unit 18 constituted as described above connects the connecting armature 97*a* to the third switching contact 93 and the second switching contact 42, and connects the connecting armature 97*b* to the fifth switching contact 96 and the first switching contact 34. When the knob 89 is pushed in the opposite direction, the switching control unit 18 connects the connecting armature 97*a* to the second switching contact 42 and the fifth switching contact 96, and connects the connecting armature 97*b* to the fourth switching contact 94 and the first switching contact 34.

Then, as shown in FIGS. 13 and 14, when the lever 98 is in the neutral position, the lever project 80 of the lever 98 is sandwiched between the trigger stopper 45 of the control unit 11 and the lever engagement projection 40 on the main unit side. In such state, the control unit (trigger) 11 is moved in the direction indicated by arrow A (that is, is retracted), and the forward end of the trigger stopper 45, though pressed by the lever projection 80, still contacts the lever engagement projection 40 on the main unit and thus stops the movement of the lever 98. Therefore, when the lever 98 is in the neutral potion and a force is applied to the control unit 11 in the direction indicated by the arrow, that force is not directly transmitted to the lever central shaft 85, thus enabling damage to the lever central shaft 85 to be avoided.

Figure 15:
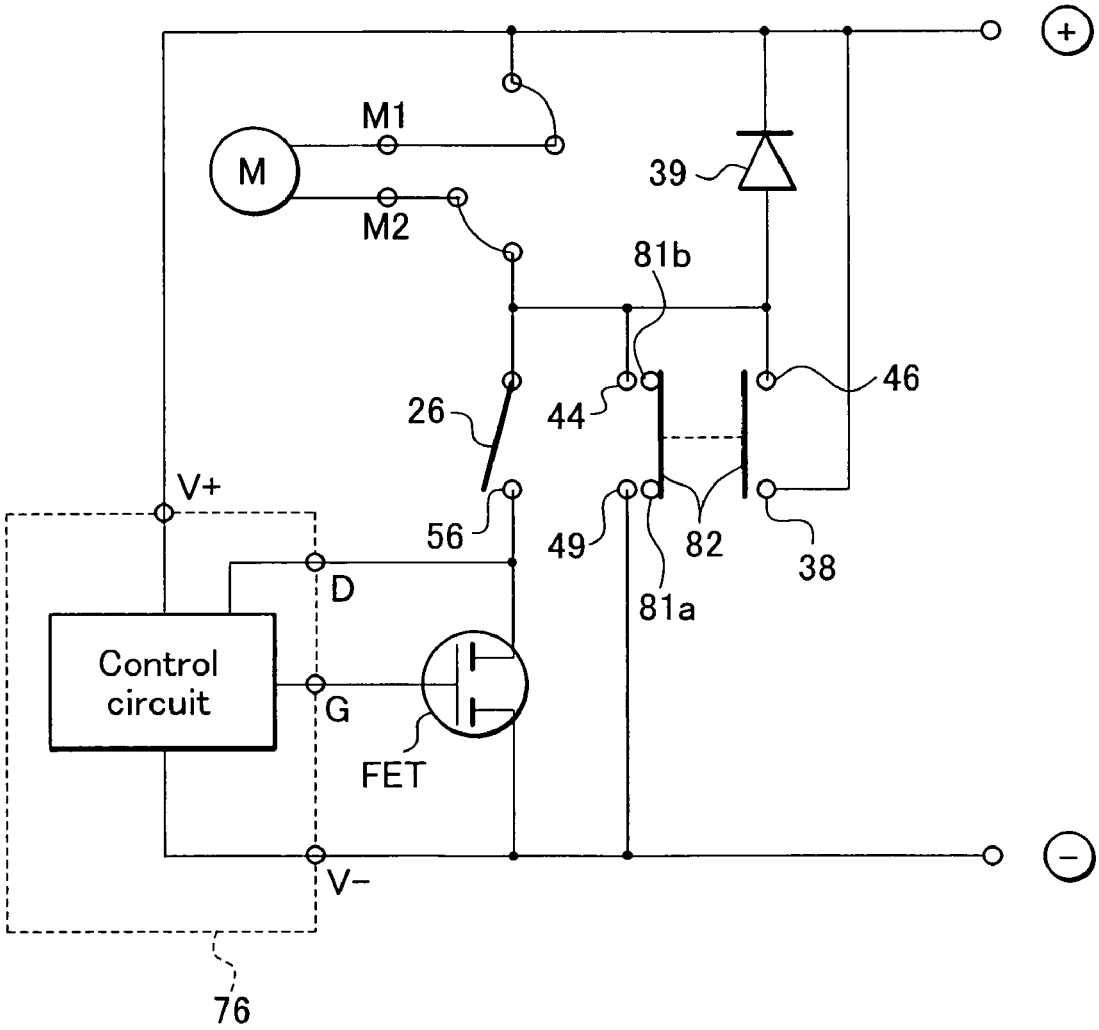
FIG. 15 is an equivalent circuit diagram showing the relation between the switches of the switch mechanism, including the motor and the switching element.

The switch mechanism described above will now be described with reference to the equivalent circuit diagram shown in FIG. 15.

The switch mechanism is provided with motor brake contacts 46, 38 for the motor brake, disposes the movable armature 82 mounting short-circuit contacts 81*a*, 81*b* within the movable frame 78 so as to move together with the springs 83, 84, and uses the load of the sliding frame spring 84 and the return spring 15 mounted on the sliding control element 12 which is mounted on the control unit 11 so as to form a bridging contact between the short-circuit contacts 81*a*, 81*b* mounted on the movable armature 82 and the motor brake contacts 46, 38.

When the control unit 11 is pushed in, the sliding control element 12 that is coupled to the control unit 11 also can move, such that, when the amount by which the control unit 11 is moved reaches a certain level, and the short-circuit contacts 81*a*, 81*b* mounted on the movable armature 82 form a bridge with and contact the short-circuit contact 44 of the terminal strip 29 and the contact 49 of the negative power terminal strip 32 so as to short-circuit the drain and the source of the control element (FET) 14, allowing 100 of the power supply voltage to be applied to the motor. At this time the contact pressure of the contacts can be maintained at or above a certain level by the load of the contact support spring 83 inside the movable frame 78.

Thus, as described above, even when the sliding control element 12 is pressed and pulled, the pair of contacts 81*a*, 81*b* is coerced by the force of the springs so as to maintain the state of contact, enabling the contact state to be maintained despite vibrations imparted to the switch mechanism.

The switch circuit of the trigger switch comprising the switch mechanism constituted as described above is controlled by a control switch and an auxiliary switch mounted on the sliding circuit substrate 76, such that the rotation of the motor can be controlled by operation of the power switch and the short circuit switch that makes possible the supply of power to the motor.

The switch circuit forms the switch mechanism described above, such that the four functions of supplying power to the motor, controlling the speed of the motor according to how much the control unit is operated, short-circuiting the circuits to the motor and supplying power according to how much the control unit is operated, and short-circuiting the motor power circuits when stopping the motor can be carried out by a single sliding action operation of the control unit 11.

Figure 16:
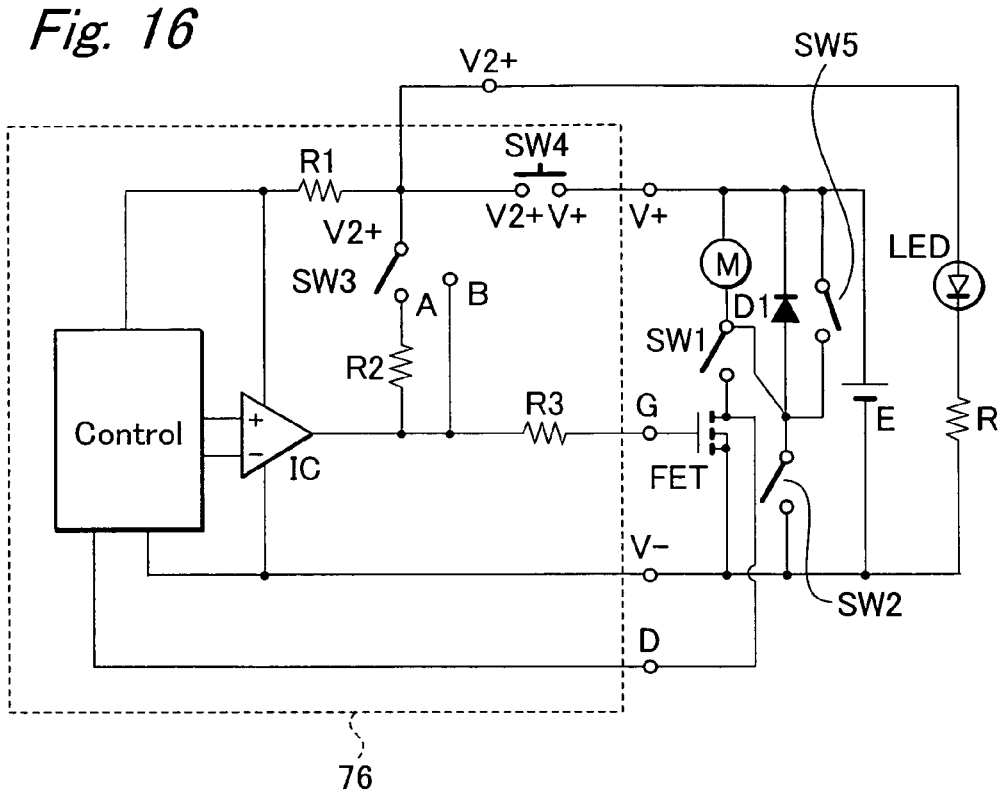
FIG. 16 is a circuit diagram of the trigger switch.

As shown in FIG. 16, the switch circuit according to the present invention having the above-described functions comprises the sliding circuit substrate 76, the switching FET, motor M, reflux diode D, short-circuit switch SW2, power switch SW1, motor brake switch SW5, power source E, light-emitting diode LED constituting light-emitting means, and resistor R, which are arranged in a manner now to be described.

The motor M, the power switch SW1 and the switching element FET are connected in series between the positive V+ terminal and the negative V− terminal of the sliding circuit substrate 76. Parallel to these elements, the diode D and the short-circuit switch SW2 are connected in series, as are the power source E and the motor brake switch SW5. In addition, the light-emitting diode LED and the resistor R are connected in series between the positive V+ terminal and the negative V− terminal of the sliding circuit substrate 76.

Within the sliding circuit substrate 76, the auxiliary switch SW4 is connected to the V+ terminal that supplies the power source E, with the control switch SW3 connected on the output side, connected to terminal G through a resistor R3, and connected to the gate of the switching element FET.

As described with reference to FIGS. 6A-8A, the power switch SW1 is turned ON and OFF by the sliding knob 25 of the sliding control element 12 over the surface of the switching bar 26 of the power control unit 27.

As described with reference to FIGS. 9A-11B, the short-circuit switch SW2 bridges the two short-circuit contacts 81*a*, 81*b* provided on the movable armature 82 provided in the movable frame 78 of the motor brake and control element short-circuit unit 24.

Figure 17:
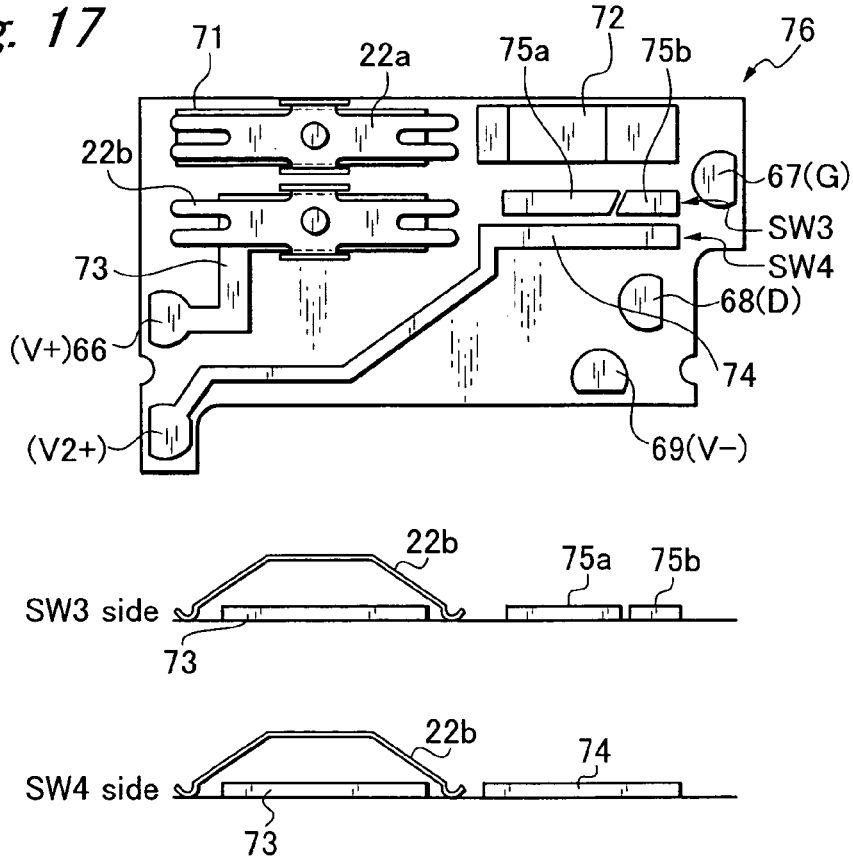
FIG. 17 is a diagram illustrating the state of the contacts on the sliding circuit substrate and the movement of the switch-moving element.

The control switch SW3, as shown in FIG. 17, switches ON and OFF depending on the movement of the switch moving contact 22*b* that moves so as to straddle the gap between a first and a second contact 75*a*, 75*b* and the control contact 73. When the switch is turned ON via a resistor R2 and the switching element is turned ON and the motor rotates at high speed, the short-circuit state is switched ON and the power supply voltage is supplied to the switching element FET gate.

As shown in FIG. 14, the auxiliary switch SW4 switches ON/OFF depending on how much the switch moving contact 22*b* that moves so as to straddle the auxiliary contact 74 and the control contact 73 is moved, and supplies power to the sliding circuit substrate 76.

The motor brake switch SW5 switches ON when the two short-circuit contacts 81*a*, 81*b* provided on the movable armature 82 provided in the movable frame 78 of the motor brake and control element short-circuit unit 24 contact the motor brake contacts 46, 38. In other words, a short is created across the motor M and the brake is applied when the short-circuit contacts 81*a*, 81*b* provided on the movable armature 82 are impelled to contact the motor brake contacts 46, 38 by the load of the sliding frame spring 84 and the return spring 15 mounted on the sliding control element 12 which in turn is mounted on the control unit 11.

A description will now be given of the switch comprised as described above.

Figure 21:
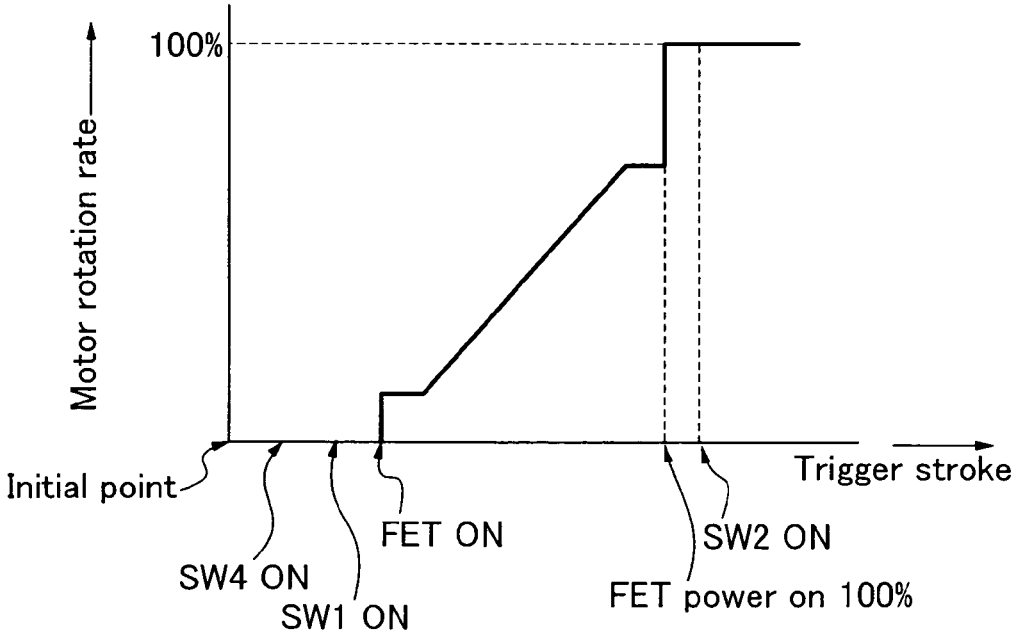
FIG. 21 is a graph showing motor control states.

(1) First, because the switch moving contact 22*b* is positioned so as to straddle the control contact 73 as shown in FIGS. 17 and 21, the auxiliary switch SW4 is held open like the circuit shown in FIG. 16. At this time the control unit 11 is not pulled, and therefore the motor brake switch SW5 is ON and the motor M is braked.

Figure 18:
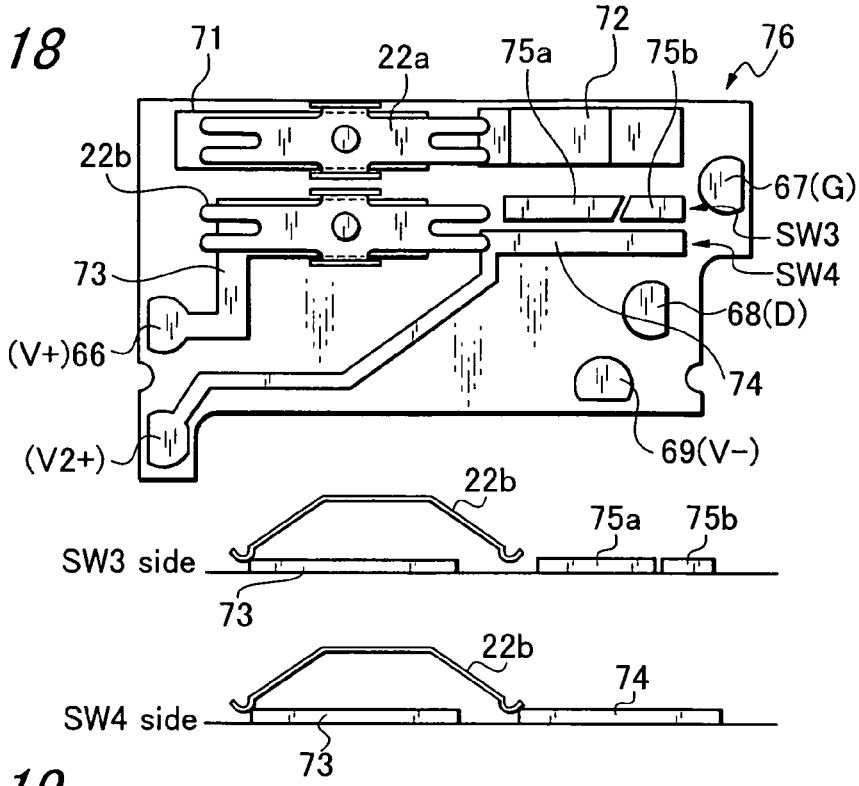
FIG. 18 is a diagram illustrating the state of the contacts on the sliding circuit substrate and the movement of the switch-moving element.

(2) When in such state the trigger (the control unit 11) is pulled, the motor brake turn switches OFF, the switch moving contact 22*b* moves as shown in FIGS. 18 and 21, and the control contact 73 and the auxiliary contact 74, which are longer than the first contact 75*a*, are electrically connected to each other, turning the auxiliary switch SW4 ON. When the auxiliary switch is turned ON, in the circuit shown in FIG. 16 the power source E supplies power to the light-emitting diode LED which is a light-emitting means and the light-emitting diode LED emits light. At this time the control switch SW3 remains OFF because it is not in contact with the first contact 75*a*. Further, when the trigger is retracted the power switch SW1 turns ON.

Figure 19:
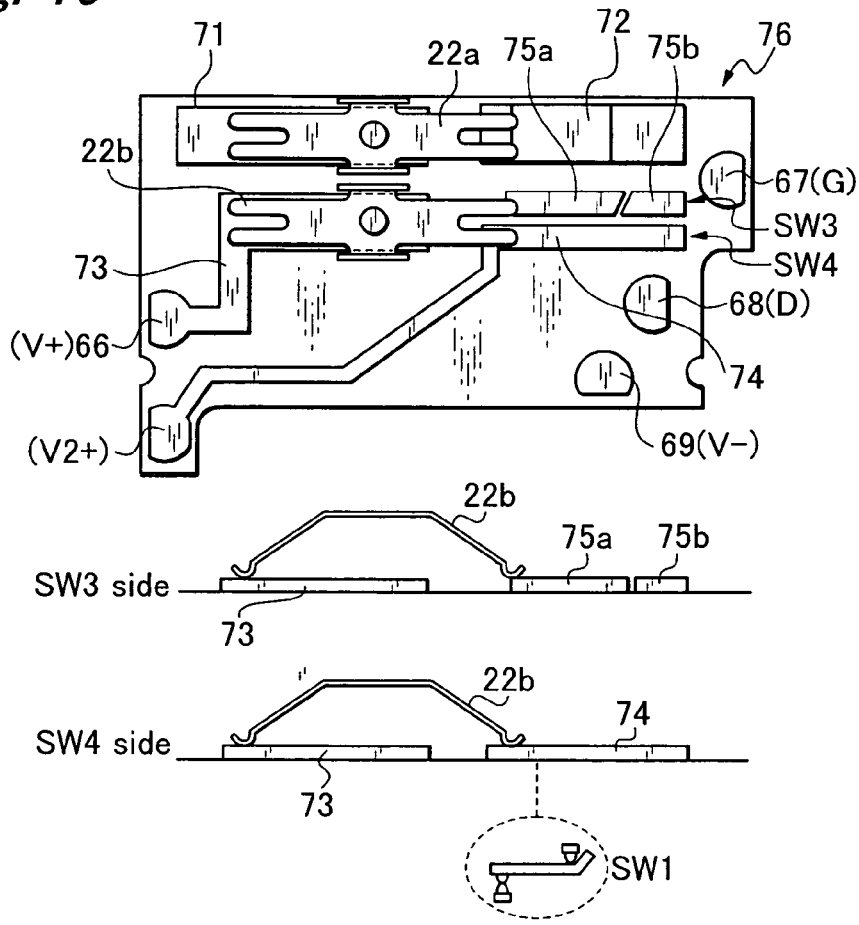
FIG. 19 is a diagram illustrating the state of the contacts on the sliding circuit substrate and the movement of the switch-moving element.

(3) Further, when the trigger is pulled the switch moving contact 22*b* moves in tandem as shown in FIGS. 19 and 21 so as to electrically connect the control contact 73 and the first contact 75*a*, causing the control switch SW3 to connect to the terminal A side and turn ON. When control switch SW3 turns ON, in the circuit shown in FIG. 16, voltage from the power source E passes through the auxiliary switch SW4, the first contact 75*a* of the control switch SW3 and the resistor R2, and is input to the gate of the switching element FET, turning the switching element FET ON. Then, when the trigger is retracted further, the rotation control moving contact 22*a* coupled to the trigger is retracted, controlling the rotation of the motor M. This point will be described later with reference to the circuit shown in FIG. 22 that performs motor M rotation control.

Figure 20:
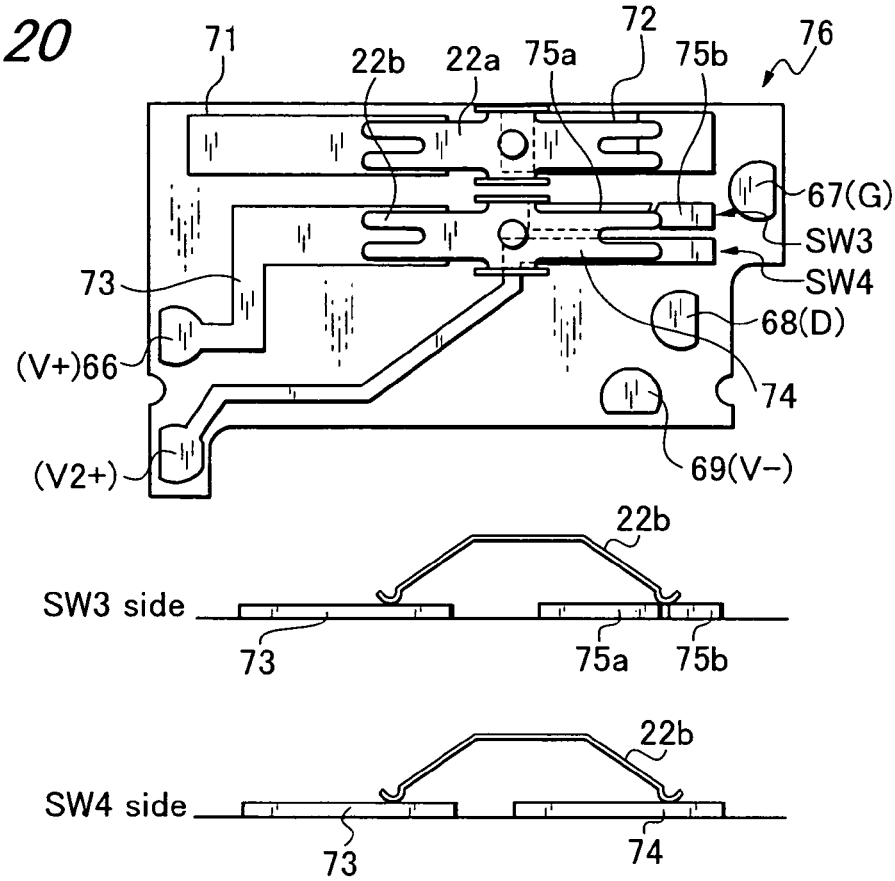
FIG. 20 is a diagram illustrating the state of the contacts on the sliding circuit substrate and the movement of the switch-moving element.

(4) As shown in FIGS. 20 and 21, when the trigger is further retracted and the motor M reaches its highest speed of rotation, the switch moving contact 22*b* that moves in tandem with the retraction of the trigger electrically connects the control contact 73 and the second contact 75*b* to short the control switch SW3 (that is, connects to terminal B shown in FIG. 13) and power supply voltage is supplied to the gate of the switching element FET and the FET becomes 100 percent electrically conductive. When in this state the trigger is further retracted, the short-circuit switch SW2 turns ON and the motor M is set at high-speed rotation.

When the power switch SW1 turns ON as described above, the control switch SW3 turns OFF, and therefore the power switch SW1 can be turned ON in a state in which the voltage supplied to the gate of the switching element FET is cut off, and thus can be turned ON in a state in which there is no electric potential difference at the power switch SW1. Further, when the short-circuit switch SW2 is turned ON, the power supply voltage is supplied to the switching element FET gate and the short-circuit switch SW2 can be turned ON in a state in which the FET is 100 percent electrically conductive.

Figure 22:
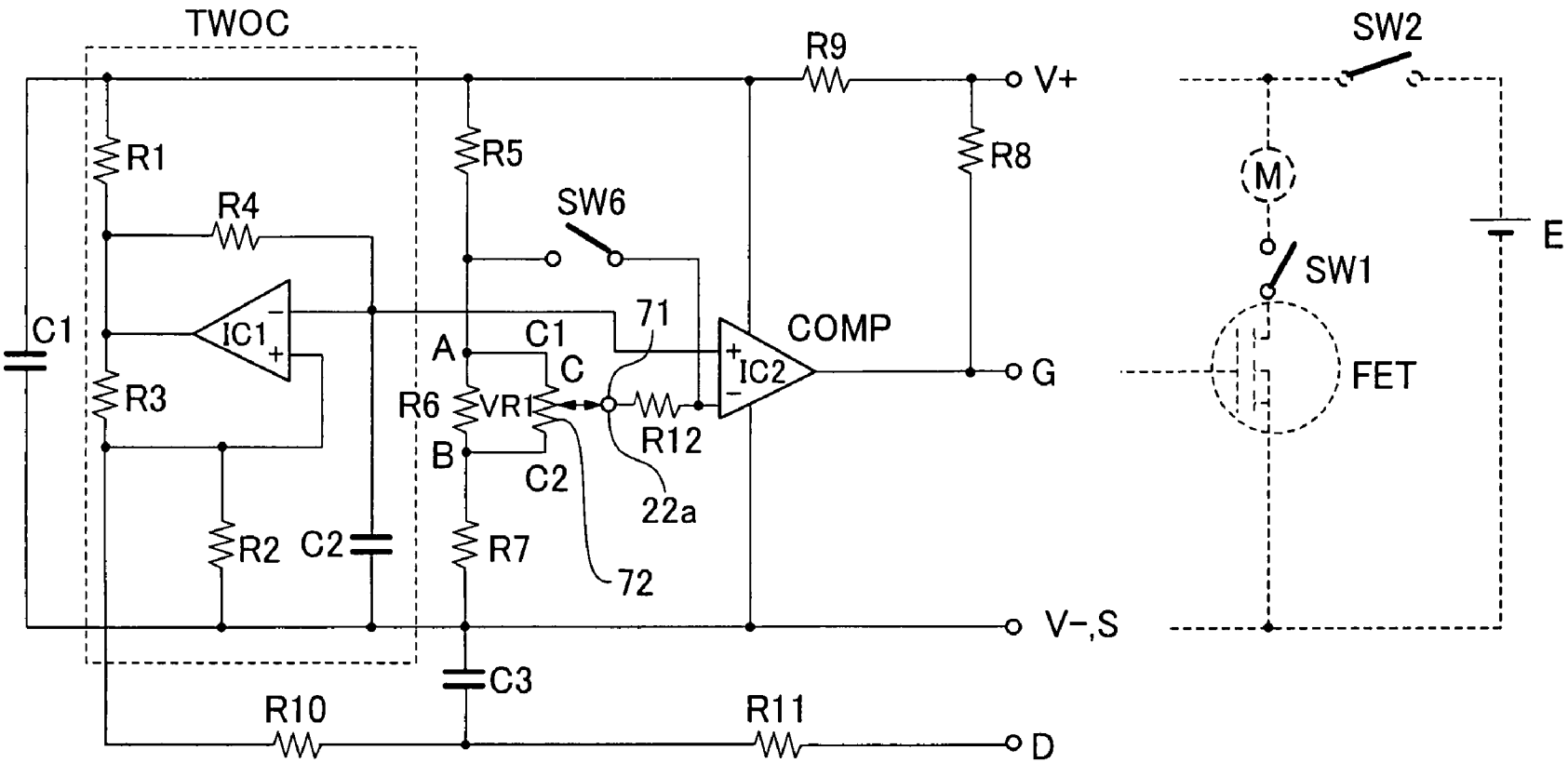
FIG. 22 is a circuit diagram illustrating control of the switching element by the rotation control moving contact.

FIG. 22 shows a switch circuit for controlling the rotation of the motor based on the rotation control moving contact 22*a* that moves in tandem with the retraction of the trigger. As shown in the diagram, the switch circuit comprises a triangular wave oscillation circuit TWOC, which is a reference signal output means, operating signal output means that outputs a predetermined operating signal based on the extent of operation of the operating lever, and a comparator COMP that inputs the reference signal from the reference signal output means to one input terminal (the positive side input terminal), inputs the operating signal from the operating signal output means to the other terminal (the negative side input terminal), and compares the inputted signals and supplies a predetermined control signal to the switching element, turning the switching element FET ON and OFF.

The operating signal output means comprises a resistor R5 (Ra), a resistor R6 (Rc)- and a resistor R7 (Re) connected in series between the V+ terminal and the V− terminal connected to the power source E, with the variable contact 72 connected in parallel with the resistor R6 (Rc), the rotation control moving contact 22*a* disposed so as to straddle the variable contact 72 and the sliding contact 71, and the sliding contact 71 connected to the negative input terminal of the comparator COMP through a resistor R12 (Rd). The resistor R5 and the resistor R6 are connected to the negative input terminal of the comparator COMP through a switch SW6 connected between the resistors R5 and R6. The triangular wave signal (reference signal) of the triangular wave oscillation circuit TWOC is input to the positive input terminal of the comparator COMP Terminal G is connected to the output terminal of the comparator COMP, which is connected to the gate of the switching element FET, and supplies the control signal to the switching element FET.

As shown in FIGS. 4, 5 and 17, the rotation control moving contact 22*a*, which carries out motor rotation control in the speed control unit 23, moves in tandem with the switch moving contact 22*b* and is disposed so as to straddle the sliding contact 71 and the variable contact 72. Depending on how much the sliding control unit is pulled, the rotation control moving contact 22*a* moves over the top of the variable contact 72, changing the resistance so as to control the rotation of the motor.

Figure 25:
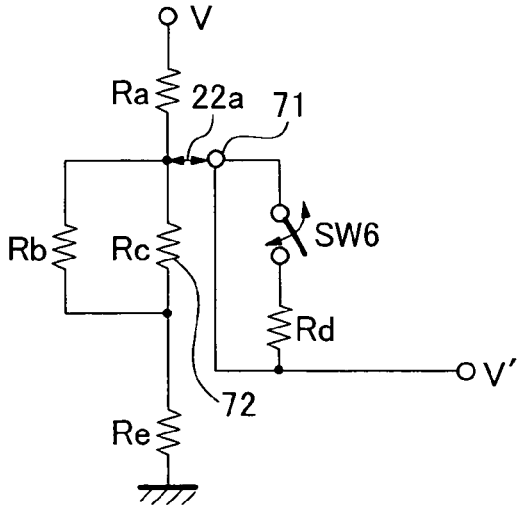
FIG. 25 is an equivalent circuit diagram of the circuits involved in rotation control according to the rotation control moving contact.
Figure 26:
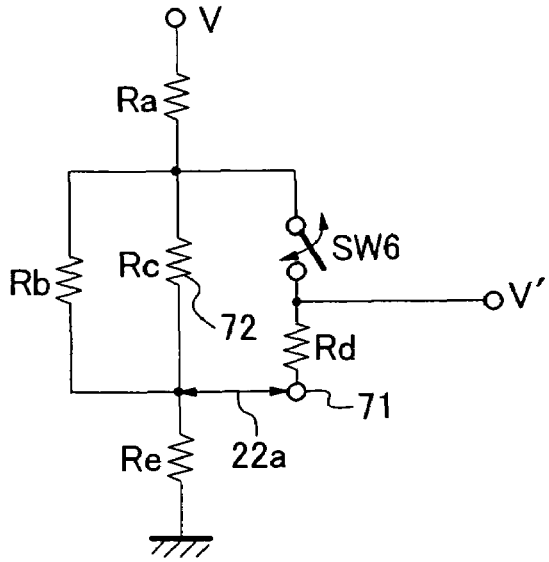
FIG. 26 is an equivalent circuit diagram of the circuits involved in rotation control according to the rotation control moving contact.

The SW6 functions when the motor is rotating at high speed, and since the variable contact 72 is short-circuited when the motor is rotating at low speed, whether the switch is ON or OFF does not affect the rotation of the motor, which is proven by the fact that an output voltage v' calculated using the equivalent circuit diagram of FIG. 25 to be described later.

Figure 24:
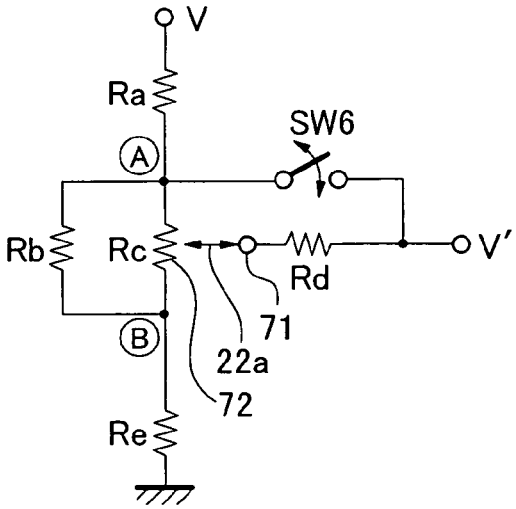
FIG. 24 is an equivalent circuit diagram of the circuits involved in rotation control according to the rotation control moving contact.

FIG. 24 is an equivalent circuit diagram composed of the rotation control moving contact 22*a*, the sliding contact 71, the variable contact 72, a control contact 73 and an auxiliary contact 74, which connects the resistor Ra, the variable resistor Rc which is the variable contact 72, and the resistor Re in series between a power source V and the ground and connects the resistor Rb in parallel with the variable resistor Rc, and disposes the rotation control moving contact 22*a* so as to straddle and electrically connect the variable contact 72 and the sliding contact 71. The high rotation speed switch SW6 is disposed between the starting position of the variable resistor 72 and the output side of the resistor Rd.

Figure 23:
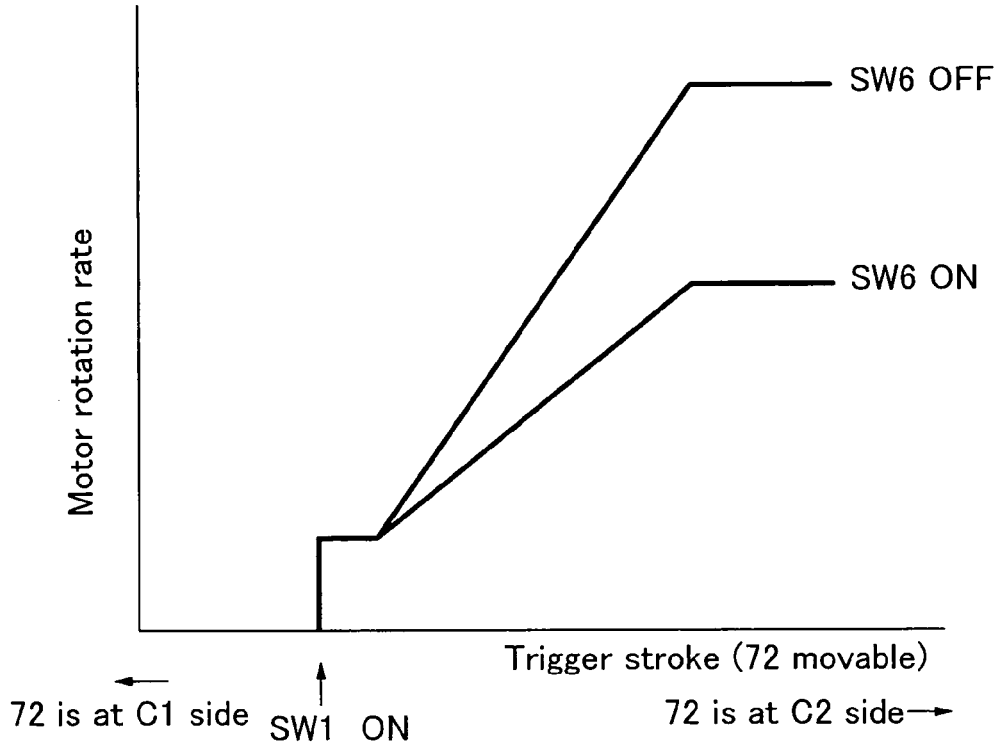
FIG. 23 is a graph showing changes of rotation speed during high-speed rotation with the use of a single switch.

In the switch circuit constituted as described above, when the rotation control moving contact 22*a* is at the starting position of the variable contact 72 (the position indicated by Ⓐ in FIG. 24) the motor rotates at low speed as shown in FIG. 23, and when switch SW6 is either ON or OFF, the rotation control moving contact 22*a* is short-circuited and the output voltage V' can be given by the following equation:

$$V'=Rb\cdot Rc/(Rb+Rc)+Re/Ra+Re+Rb\cdot Rc/Rb+Rc\cdot V=(((Rb\cdot Rc+Rb\cdot Re+Rc\cdot Re)/(Rb+Rc))/((Ra\cdot Rb+Rb\cdot Re+Ra\cdot Rc+Rc\cdot Re+Rb\cdot Rc)/(Rb+Rc)))\cdot V=((Rb\cdot Rc+Rb\cdot Re+Rc\cdot Re)/(Ra\cdot Rb+Rb\cdot Re+Ra\cdot Rc+Rc\cdot Re+Rb\cdot Rc))\cdot V$$

When the rotation control moving contact 22*a* is at the ending position of the variable contact 72 (the position indicated by Ⓑ in FIG. 24) the motor rotates at high speed and the voltage that is output changes as the switch SW6 turns ON and OFF as shown in FIG. 23. The output voltage V' when the switch SW6 is ON can be given by the following equation:

$$V'=((((Rb\cdot Rc\cdot Rd)/(Rb\cdot Rc+Rb\cdot Rd+Rb\cdot Rc))+Re)/(Ra+Re+(Rb\cdot Rc\cdot Rd)/(Rb\cdot Rc+Rb\cdot Rd+Rc\cdot Rd)))\cdot V=(((Ra\cdot Rc\cdot Rd+Rb\cdot Rc\cdot Re+Rb\cdot Rd\cdot Re+Rb\cdot Rc\cdot Re)/(Rb\cdot Rc+Rb\cdot Rd+Rb\cdot Rc))/(Ra\cdot Rb\cdot Rc+Ra\cdot Rb\cdot Rd+Ra\cdot Rc\cdot Rd+Rb\cdot Rc\cdot Re+Rb\cdot Rd\cdot Re+Rc\cdot Rd\cdot Re+Rb\cdot Rc\cdot Rd)/(Rb\cdot Rc+Rb\cdot Rd+Rc\cdot Rd))\cdot V=((Ra\cdot Rc\cdot Rd+Rb\cdot Rc\cdot Re+Rb\cdot Rd\cdot Re+Rb\cdot Rc\cdot Re)/(Ra\cdot Rb\cdot Rc+Ra\cdot Rb\cdot Rd+Ra\cdot Rc\cdot Rd+Rb\cdot Rc\cdot Re+Rb\cdot Rd\cdot Re+Rc\cdot Rd\cdot Re+Rb\cdot Rc\cdot Rd))\cdot V$$

The output voltage V' when the switch SW6 is OFF can be given by the following equation, indicating that the motor can be rotated at a speed higher than that when the switch SW6 is ON:

$$V'=(Re/(Ra+Re+(Rb\cdot Rc/(Rb+Rc)))\cdot V=(Re/(Ra\cdot Rb+Ra\cdot Rc+Rb\cdot Re+Rc\cdot Re+Rb\cdot Rc)/(Rb+Rc))\cdot V=((Re\cdot(Rb+Rc))/(Ra\cdot Rb+Ra\cdot Rc+Rb\cdot Re+Rc\cdot Re+Rb\cdot Rc))\cdot V$$

Thus, as described above, the comparator COMP controls the motor rpm by comparing the voltage divided by the variable contact 72 and the resistors that is input to the negative input terminal of the comparator COMP and the triangular wave signal that is input to the positive input terminal of the comparator COMP Consequently, as shown in FIG. 23, the switch SW6 accomplishes change in motor rpm from low speed to high speed with a single switch.

As described above, the turning ON and OFF of the switch SW6 enables the high-speed rotation of the motor to be set by a single switch, thereby increasing the use-value of the power hand tool as well as reducing its production cost by the equivalent of one switch. Moreover, such an arrangement permits the wiring of the sliding circuit substrate to be simplified and allows the number of switch assembly steps to be reduced.

Second Embodiment

Figure 27:
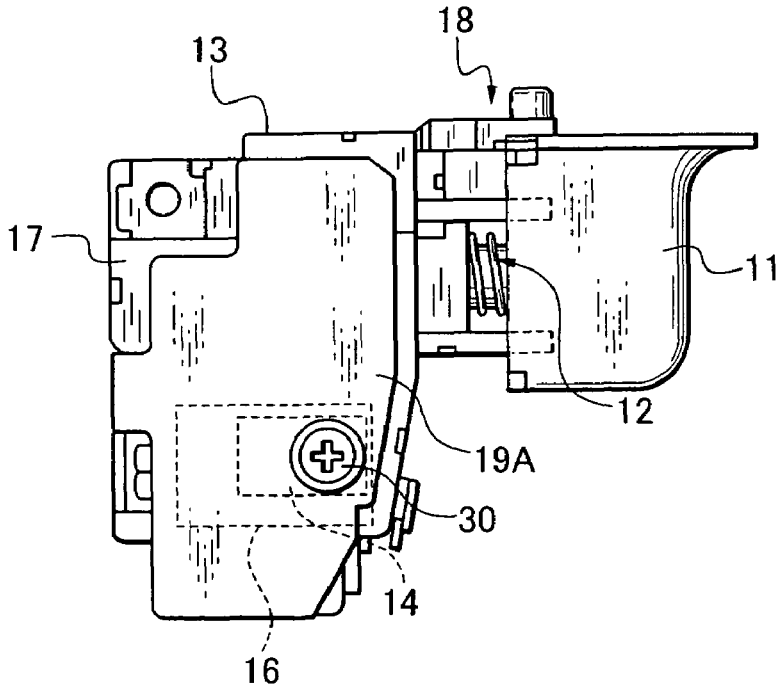
FIG. 27 is a side view showing a trigger switch according to a second embodiment of the present invention.

FIG. 27 shows a trigger switch according to a second embodiment of the present invention. The switch mechanism and switch operation mechanism of the trigger switch are the same as those of the first embodiment described above, with only the structure of the heat slinger being different from that of the first embodiment. Accordingly, a description is given of the heat slinger whereas a description of structures other than the heat slinger is omitted.

In other words, a heat slinger 19A of the present embodiment is formed as a single flat plate that covers the sidewall surfaces of the cover 17 as shown in the diagram, and secured together with the control element (FET) 14 by the screw 30. The inside surface of the heat slinger 19A directly contacts the front surface of the FET 14 contained in the FET mount 16, and thus is able to disperse evenly the heat generated by the FET 14. Forming the heat slinger 19A as a single flat plate in the foregoing manner enables the bulkiness of the heat slinger to be eliminated and thus contributes to making the switch more compact.

Figure 28:
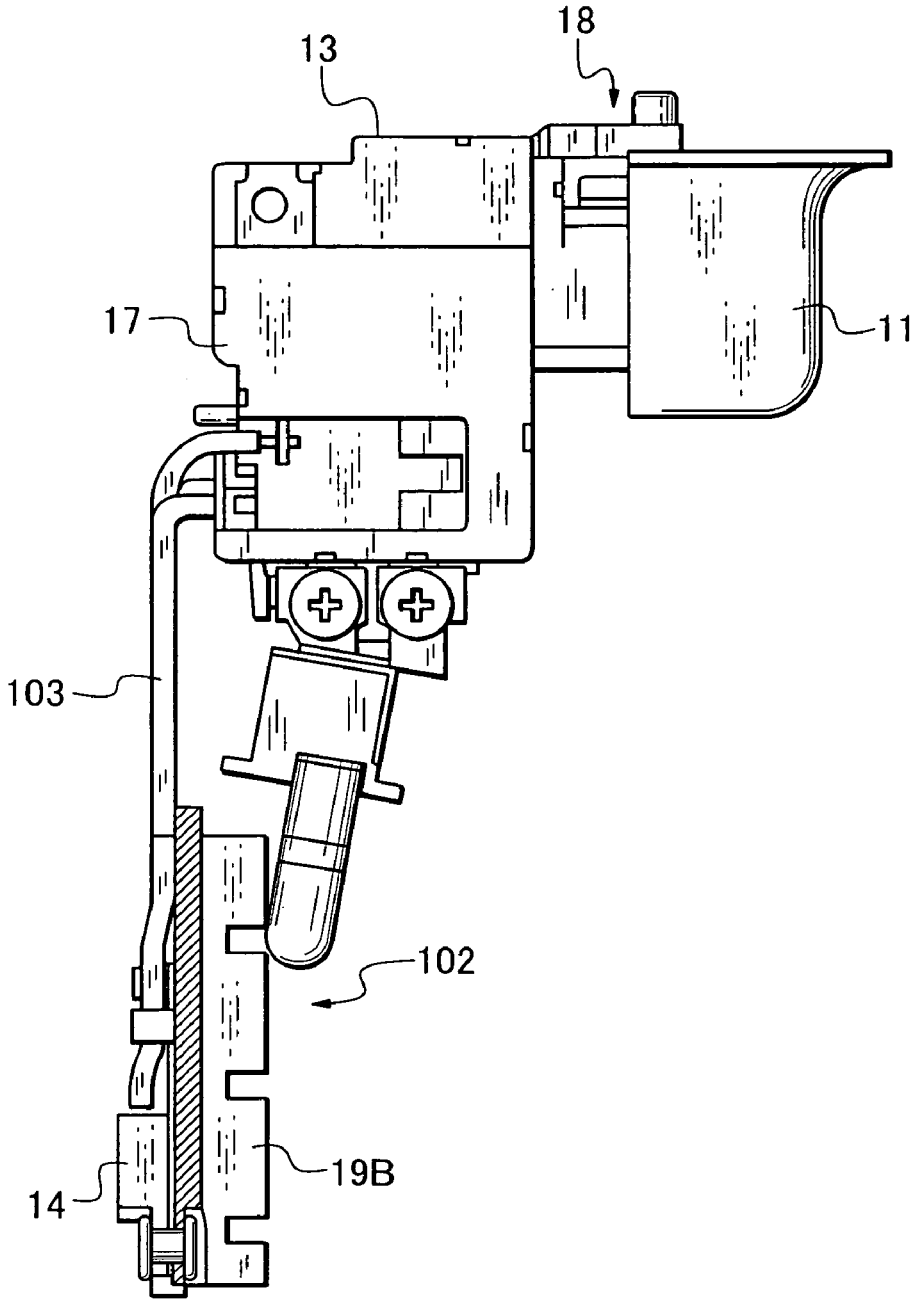
FIG. 28 is a side view showing a trigger switch according to a third embodiment of the present invention.

FIG. 28 shows a trigger switch according to a third embodiment of the present invention. The switch mechanism and switch operation mechanism of the trigger switch are the same as those of the first embodiment described above, with only the external mounting of the control element (FET) being different from that of the first embodiment, and therefore a description of is given of the heat slinger whereas a description of structures other than the heat slinger is omitted.

In other words, an element part 102 of the present embodiment comprises a lead wire 103 connected to a terminal provided on the cover 17, the control element (FET) 14 mounted in an external state and connected to the lead wire 103, and a heat slinger 19B that disperses heat from the FET 14. Being able to mount the FET 14 externally in the foregoing manner enhances design freedom and enables even a trigger switch having the same switch mechanism and switching mechanism as a non-externally mounted FET trigger switch to meet user demands flexibly. As many apparently widely different embodiments of the present invention can be made without departing from the spirit and scope thereof, it is to be understood that the invention is not limited to the specific embodiments thereof except as defined in the appended claims.

What is claimed is:

1. A trigger switch comprising a switch mechanism equipped with a sliding circuit substrate and installed inside a case, and a control unit provided on the outside of the case to operate the switch mechanism according to sliding thereof, the switch mechanism comprising:

a power control unit that turns a plurality of switches provided on the switch mechanism ON and OFF depending on a degree of retraction of the control unit by moving a pressing member over a top of a seesaw-shaped switching bar;

a motor brake and control element short-circuit unit that moves a movable armature having two short-circuit contacts, the movable armature sandwiched and supported by two springs; and a speed control unit that, by sliding a plurality of moving contacts arranged in parallel over sliding circuit contacts of the sliding circuit substrate, controls a supply of power and a control element so as to control rotation of a motor, the motor brake and control element short-circuit unit simultaneously short-circuiting the two short-circuit contacts provided on the movable armature against contacts of a short-circuit terminal strip against an urging force of the springs so as to effect an electrical connection, and short-circuiting the control element at some arbitrary point in time at which the degree of retraction of the control unit is increased.

2. A trigger switch according to claim 1, wherein the switch mechanism comprises a switch circuit comprising:

a power switch connected in series to the motor;

a switching element connected in series to the motor via the power switch;

a short-circuit switch connected in parallel to the switching element;

a motor brake switch that stops the motor;

a drive unit that drive the switching element;

a control switch that supplies voltage to the gate of the switching element when the control unit is retracted; and an auxiliary switch that supplies DC power to the drive unit when the control unit is retracted, the switch mechanism turning the auxiliary switch ON and supplying power to the drive unit when the control unit is retracted, when the power switch is turned ON and power is supplied to the motor, the switch mechanism turning the control switch ON and supplying voltage to the switching element gate through a resistance and making a state in which the control switch is turned ON a position at which DC power is supplied directly and directly supplying DC power to the switching element gate so as to place the switching element into a state in which it can be 100 percent electrically conducive, and further, turning the short-circuit switch ON and operating the power switch, the short-circuit switch, the motor brake switch, the control switch and auxiliary switch in tandem with the control unit.

3. A trigger switch according to claim 2, wherein electric power is supplied to a light emitting means when the auxiliary switch is ON.

4. A trigger switch according to claim 2, wherein the moving contacts that form the auxiliary switch and the control switch are a single switch moving contact.

5. A trigger switch according to claim 1, wherein the switch mechanism is equipped with a switch circuit comprising:

reference signal output means that outputs a reference signal;

operating signal output means that outputs a predetermined operating signal based on an operating state of an operating lever;

a switching element connected in series to the motor that controls the rotation of the motor; and a comparator that inputs the reference signal from the reference signal output means to one input terminal and inputs the operating signal from the operating signal output means to another terminal, compares the input signals, and supplies a predetermined control signal to the switching element so as to turn the switching element ON and OFF;

wherein the operating signal output means having:

a rotation control moving contact that connects a resistor Ra, a variable resistor Rc and a resistor Re in series between the power source and the ground, connects a resistor Rb in parallel to the variable resistor Rc, and straddles a variable contact and a sliding contact so as to electrically connect the variable contact and the moving contact; and a high-speed rotation switch provided between a starting position of the variable contact and the output side of a resistor Rd connected to the rotation control moving contact.

6. A trigger switch according to claim 1, further comprising:

a control element housing formed on an exterior side wall surface of a cover that covers the case and contains the control element; and a heat slinger that covers an outside surface of the cover and the case.

7. A trigger switch according to claim 1, further comprising:

a control element housing formed on an exterior side wall surface of a cover that covers the case and contains the control element; and a heat slinger that covers only an outside surface of the cover where the control element is located.

8. A trigger switch according to claim 1, wherein a plurality of packing structures is provided on a sliding shaft that slides according to sliding of the control unit.

9. A trigger switch according to claim 1, wherein the sliding circuit substrate that comprises the switch mechanism installed inside the case is guided by internal side wall surfaces of the cover when inserted therein and engages a spring on a projection provided on an armature that forms the switch mechanism at a connecting part of the sliding circuit substrate so as to effect an electrical connection between the sliding circuit substrate and the switch mechanism.

10. A trigger switch according to claim 1, further comprising a control element housing formed on an exterior side wall surface of a cover that covers the case and contains the control element, wherein the control element contained in the control element housing is an external structure.

11. A trigger switch according to claim 1, wherein the switch mechanism comprises a switching lever that uses the central shaft of the lever provided at a central location therein as a fulcrum and switches the rotation of the motor between forward, reverse and neutral OFF states, the switching lever configured so that, when in the neutral OFF state, a lever projection provided on the switching lever is sandwiched between a lever stopper provided on the switch body and a trigger stopper provided on the control unit so as to stop the sliding of the control unit, and when the control unit moves in a direction of operation, the lever projection provided on the switching lever contacts the lever stopper provided on the switch body so as to stop exertion of force on the lever central shaft.

* * * * *